US008511895B2

(12) United States Patent
Burchfield et al.

(10) Patent No.: US 8,511,895 B2
(45) Date of Patent: Aug. 20, 2013

(54) BIODEGRADABLE LAWN WASTE COLLECTION SYSTEM

(75) Inventors: Brent Burchfield, Powell, OH (US); Ryan Crisp, Lewis Center, OH (US); Eric Fickas, Powell, OH (US); Paul Kolada, Bexley, OH (US); Michael Lorenz, Gahanna, OH (US); Donald Meves, Gahanna, OH (US); Shannon Staats, Ostrander, OH (US); Herman Jones, Palaskala, OH (US)

(73) Assignee: Green Bag, LLC, Dallas, TX (US)

( * ) Notice: Subject to any disclaimer, the term of this patent is extended or adjusted under 35 U.S.C. 154(b) by 223 days.

(21) Appl. No.: 12/823,613

(22) Filed: Jun. 25, 2010

(65) Prior Publication Data

US 2011/0150369 A1 Jun. 23, 2011

Related U.S. Application Data

(60) Provisional application No. 61/220,869, filed on Jun. 26, 2009.

(51) Int. Cl.
*B65D 33/00* (2006.01)
*B65B 67/04* (2006.01)

(52) U.S. Cl.
USPC ..... 383/33; 383/104; 248/99

(58) Field of Classification Search
USPC ..... 383/34, 34.1, 36, 104, 33; 248/99
See application file for complete search history.

(56) References Cited

U.S. PATENT DOCUMENTS

| | | | | |
|---|---|---|---|---|
| 176,555 | A | 4/1876 | Scholfield | |
| 1,583,083 | A | 5/1926 | Macaraig | |
| 1,879,410 | A * | 9/1932 | Morris et al. | 493/480 |
| D96,609 | S | 8/1935 | Kichu et al. | |
| D96,634 | S | 8/1935 | Thucaky | |
| 2,201,888 | A | 5/1940 | Deutsch | |
| 2,636,656 | A * | 4/1953 | Tanabe | 141/314 |
| 3,014,516 | A | 12/1961 | Mueller | |
| 3,288,325 | A | 11/1966 | Fulton | |
| 3,480,059 | A * | 11/1969 | Schoening | 220/9.2 |
| 3,563,002 | A | 2/1971 | Givin | |
| 3,574,272 | A | 4/1971 | Krewson | |
| 3,747,653 | A * | 7/1973 | Ringer | 383/12 |
| 3,915,329 | A * | 10/1975 | Zaks | 141/390 |
| 3,934,999 | A * | 1/1976 | Meier | 71/9 |

(Continued)

OTHER PUBLICATIONS

International Searching Authority (USPTO), International Search Report and Written Opinion for International Application No. PCT/US2010/039998, mailed Sep. 1, 2010, 11 pages.

*Primary Examiner* — Justin Larson
*Assistant Examiner* — Peter Helvey
(74) *Attorney, Agent, or Firm* — David H. Judson

(57) ABSTRACT

A biodegradable lawn waste collection system is provided. The system generally includes a waste receiver, a shaping insert, and a handle. The waste receiver may comprise a mesh structure having a filling end and a sealing end. The mesh structure may be formed from a biodegradable polymer composition. The shaping insert is configured for removable reception within the filling end of the waste receiver. The shaping insert provides the waste receiver with rigidity and stability when filling the waste receiver with lawn waste. After the waste receiver has been filled with lawn waste, the shaping inert is removed and the filling end is secured, such as by tying a knot. The full waste receiver is then releasably attached to the handle, which enables the full waste receiver to be easily carried or dragged to a desired destination.

16 Claims, 17 Drawing Sheets

(56) References Cited

U.S. PATENT DOCUMENTS

| | | | | | |
|---|---|---|---|---|---|
| 3,936,087 | A | * | 2/1976 | Alexander | 248/99 |
| 3,957,098 | A | * | 5/1976 | Hepworth et al. | 383/45 |
| 3,983,914 | A | * | 10/1976 | Benson | 141/390 |
| 3,995,414 | A | | 12/1976 | Kerr et al. | |
| 4,134,225 | A | | 1/1979 | Welch | |
| 4,155,212 | A | | 5/1979 | Marchese | |
| 4,240,474 | A | | 12/1980 | Perkins | |
| 4,404,254 | A | | 9/1983 | Franz | |
| 4,628,007 | A | * | 12/1986 | Ledsham | 428/542.8 |
| 4,653,214 | A | * | 3/1987 | Cline | 43/14 |
| 4,739,880 | A | | 4/1988 | Sawyer et al. | |
| 4,747,259 | A | | 5/1988 | Kline et al. | |
| 4,749,011 | A | | 6/1988 | Rylander | |
| 4,760,982 | A | | 8/1988 | Cooke | |
| 4,772,133 | A | | 9/1988 | Volk | |
| 4,884,603 | A | | 12/1989 | Simpson | |
| 4,890,652 | A | | 1/1990 | Hoerner | |
| 4,955,496 | A | | 9/1990 | Nelson | |
| 4,979,547 | A | | 12/1990 | Hoerner | |
| D314,150 | S | | 1/1991 | Preciutti | |
| 5,003,758 | A | | 4/1991 | Bernstein | |
| 5,011,103 | A | * | 4/1991 | Hayes et al. | 248/99 |
| 5,026,105 | A | | 6/1991 | Feldman | |
| 5,031,277 | A | * | 7/1991 | Coker | 15/257.3 |
| 5,129,609 | A | | 7/1992 | Tobin | |
| 5,149,028 | A | * | 9/1992 | Blackaby et al. | 248/101 |
| 5,169,198 | A | | 12/1992 | Volk et al. | |
| 5,179,824 | A | | 1/1993 | Ridge et al. | |
| 5,180,125 | A | | 1/1993 | Caveney | |
| 5,181,757 | A | | 1/1993 | Montoya | |
| 5,183,339 | A | * | 2/1993 | Williams | 383/33 |
| 5,213,141 | A | | 5/1993 | Dorman | |
| D336,732 | S | | 6/1993 | Joyner | |
| 5,226,554 | A | * | 7/1993 | Dauphinais | 248/95 |
| D340,863 | S | | 11/1993 | Daigle | |
| 5,393,023 | A | * | 2/1995 | Callan | 248/97 |
| D361,263 | S | | 8/1995 | Carmo et al. | |
| 5,440,978 | A | | 8/1995 | O'Brien | |
| D362,622 | S | | 9/1995 | Van Davelaar | |
| 5,487,581 | A | | 1/1996 | Carmo et al. | |
| 5,507,544 | A | | 4/1996 | McQuade et al. | |
| 5,599,052 | A | | 2/1997 | Van Davelaar | |
| 5,615,921 | A | | 4/1997 | Marley et al. | |
| 5,645,306 | A | | 7/1997 | Kosteniuk | |
| 5,667,266 | A | | 9/1997 | Giocanti | |
| D385,189 | S | | 10/1997 | Weller | |
| 5,673,544 | A | | 10/1997 | Voigt | |
| D387,555 | S | | 12/1997 | Miller | |
| 5,716,033 | A | | 2/1998 | Gibson | |
| 5,765,614 | A | | 6/1998 | Kardosh | |
| 5,797,166 | A | | 8/1998 | Wagenheim | |
| D400,785 | S | * | 11/1998 | Randall | D9/434 |
| 5,836,634 | A | | 11/1998 | Finkelman | |
| 5,868,364 | A | | 2/1999 | MacMillan | |
| 5,871,037 | A | * | 2/1999 | Feldt | 141/391 |
| 5,879,039 | A | * | 3/1999 | Baker et al. | 294/178 |
| 5,915,768 | A | * | 6/1999 | Young | 294/214 |
| D412,846 | S | | 8/1999 | Solis et al. | |
| 5,960,983 | A | | 10/1999 | Chan | |
| 6,007,030 | A | | 12/1999 | Judge | |
| D420,508 | S | | 2/2000 | Kohlhase | |
| 6,044,877 | A | * | 4/2000 | Bennet | 141/390 |
| 6,065,512 | A | * | 5/2000 | Munn, II | 141/391 |
| 6,138,962 | A | | 10/2000 | Spooner | |
| D434,890 | S | | 12/2000 | Cooper | |
| 6,189,841 | B1 | | 2/2001 | LaPoint et al. | |
| 6,302,583 | B1 | * | 10/2001 | Steinmetz | 383/33 |
| 6,315,143 | B1 | * | 11/2001 | Dotts | 220/9.2 |
| 6,318,419 | B1 | * | 11/2001 | Lee | 141/108 |
| D452,435 | S | | 12/2001 | Lichter | |
| 6,340,037 | B1 | * | 1/2002 | Stafford | 141/316 |
| D455,348 | S | | 4/2002 | Fludd | |
| D459,880 | S | | 7/2002 | Tung | |
| 6,431,230 | B1 | * | 8/2002 | Tsigas | 141/391 |
| D466,282 | S | | 12/2002 | Wardlaw | |
| 6,499,781 | B1 | | 12/2002 | Flynn | |
| 6,511,114 | B1 | | 1/2003 | Fludd | |
| 6,520,365 | B2 | | 2/2003 | Schneider | |
| 6,554,810 | B1 | * | 4/2003 | Wilk et al. | 604/323 |
| 6,616,004 | B1 | | 9/2003 | Erickson et al. | |
| D481,252 | S | | 10/2003 | Fung | |
| D482,522 | S | | 11/2003 | Hassett | |
| D482,924 | S | | 12/2003 | Fung | |
| D484,353 | S | | 12/2003 | Tung | |
| D484,731 | S | | 1/2004 | Tung | |
| D488,020 | S | | 4/2004 | Fung | |
| D489,529 | S | | 5/2004 | Vish et al. | |
| D491,364 | S | | 6/2004 | Vish et al. | |
| 6,810,651 | B1 | | 11/2004 | Washington | |
| 6,810,652 | B1 | | 11/2004 | Regalado | |
| 6,830,170 | B2 | * | 12/2004 | Abel | 224/634 |
| 6,839,923 | B2 | * | 1/2005 | Blessman | 5/489 |
| 6,860,094 | B1 | * | 3/2005 | Abrams | 56/202 |
| 6,883,207 | B2 | | 4/2005 | Le Roux | |
| D508,931 | S | | 8/2005 | Griggs et al. | |
| D510,944 | S | | 10/2005 | Griggs et al. | |
| 6,960,374 | B1 | * | 11/2005 | Terada et al. | 428/35.7 |
| D520,362 | S | | 5/2006 | Powell | |
| 7,093,867 | B2 | | 8/2006 | Yardley | |
| 7,138,439 | B2 | | 11/2006 | Scheer et al. | |
| D544,711 | S | | 6/2007 | Mundy et al. | |
| 7,237,753 | B2 | * | 7/2007 | Metcalfe | 248/99 |
| D555,358 | S | | 11/2007 | King | |
| 7,314,553 | B1 | * | 1/2008 | Barbe | 210/232 |
| 7,326,659 | B2 | | 2/2008 | Cederblad et al. | |
| 7,326,660 | B2 | | 2/2008 | Walraevens et al. | |
| D567,649 | S | | 4/2008 | Borkowski et al. | |
| 7,393,590 | B2 | | 7/2008 | Scheer et al. | |
| 7,490,787 | B1 | * | 2/2009 | Salazar | 241/62 |
| 7,533,916 | B2 | | 5/2009 | Eichenbaum | |
| 7,546,989 | B1 | * | 6/2009 | Lineberry et al. | 248/99 |
| D606,310 | S | | 12/2009 | Lown et al. | |
| D607,202 | S | | 1/2010 | Pidgeon et al. | |
| D625,891 | S | * | 10/2010 | Krotts et al. | D32/36 |
| 7,815,153 | B2 | * | 10/2010 | Campbell et al. | 248/99 |
| 7,815,372 | B2 | * | 10/2010 | Stanton et al. | 383/104 |
| 7,958,580 | B2 | * | 6/2011 | Zorger | 5/489 |
| 2003/0106895 | A1 | * | 6/2003 | Kalal | 220/9.2 |
| 2003/0183630 | A1 | * | 10/2003 | Schneider et al. | 220/9.2 |
| 2005/0103951 | A1 | * | 5/2005 | Metcalfe | 248/99 |
| 2006/0032991 | A1 | | 2/2006 | Gaines | |
| 2007/0095419 | A1 | | 5/2007 | Campbell et al. | |
| 2008/0029658 | A1 | | 2/2008 | Vanbost | |
| 2008/0056625 | A1 | | 3/2008 | Stanton et al. | |
| 2008/0317985 | A1 | | 12/2008 | Giro Amigo | |

* cited by examiner

BIODEGRADABLE LAWN WASTE COLLECTION SYSTEM

CROSS-REFERENCES TO RELATED APPLICATIONS

This application claims the benefit of U.S. provisional patent application Ser. No. 61/220,869, filed on Jun. 26, 2009, which is hereby incorporated by reference as if completely written herein.

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

INCORPORATION-BY-REFERENCE OF MATERIAL SUBMITTED ON A COMPACT DISC

Not applicable.

TECHNICAL FIELD

The present disclosure relates to lawn waste collection methods and devices, and more particularly, to a biodegradable lawn waste collection system.

BACKGROUND OF THE INVENTION

Many homeowners and commercial establishments with lawns, trees and other landscaping have a desire to keep such areas in an aesthetically pleasing condition. Often times this requires cutting the lawn, pruning trees and shrubs, and raking up leaves and twigs. Such activities result in yard or lawn waste that must be discarded.

A common method for disposing of such lawn waste is to collect the waste in large, paper lawn bags. After the lawn waste is collected in the paper lawn bags, the bags are typically picked up by a lawn waste recycling service or dropped off at a lawn waste recycling center.

Paper lawn bags have many drawbacks. First, paper lawn bags can be easily torn during normal use. Next, when paper lawn bags become wet they tend to disintegrate and are nearly impossible to handle. Paper lawn bags are also difficult to open and keep open when filling with lawn waste. Twigs and other lawn waste have a tendency to pierce through paper lawn bags. Finally, paper lawn bags are often difficult to carry and move when filled with lawn waste.

Although paper lawn bags have a number of drawbacks, they also have several advantages. One such advantage is that paper lawn bags are compostable. Still another advantage is that paper lawn bags are relatively inexpensive. Finally, empty paper lawn bags have the benefit of being light weight and easy to transport.

There remains an unfilled need to provide a lawn waste collection system that retains and improves on the benefits of paper lawn bags, while also addressing the many drawbacks associated with paper lawn bags. The present disclosure provides a solution to this need.

SUMMARY OF THE INVENTION

In its most general configuration, the biodegradable lawn waste collection system advances the state of the art with a variety of new capabilities and overcomes many of the shortcomings of prior methods and systems in new and novel ways. In its most general sense, the system overcomes the shortcomings and limitations of the prior art in any of a number of generally effective configurations.

Disclosed herein is a biodegradable lawn waste collection system designed and configured to allow users to easily and efficiently collect and dispose of all types of lawn waste in an environmentally friendly manner. The system generally includes a waste receiver, a shaping insert, and a handle.

The waste receiver includes a filling end, a sealing end, and generally includes a mesh structure formed from a biodegradable polymer composition. In one embodiment, the waste receiver has an extruded tubular mesh structure formed from a biodegradable polymer composition comprising polylactic acid.

The shaping insert is configured for removable reception within the filling end of the waste receiver. The shaping insert provides the waste receiver with rigidity and stability when filling the waste receiver with lawn waste. The shaping insert may have a number of different configurations. In one particular embodiment, the shaping insert comprises a collapsible tube having a circular shaping insert perimeter and a spring-coil secured to the collapsible tube.

The handle is designed and configured to facilitate the transport of at least one waste receiver containing lawn waste. The handle includes at least one attachment port for releasable attachment with the waste receiver. In a particular embodiment, the handle includes at least three attachment ports for releasable attachment with up to three waste receivers filled with lawn waste.

Numerous alterations, modifications, and variations of the preferred embodiments disclosed herein will be apparent to those skilled in the art and they are all anticipated and contemplated to be within the spirit and scope of the method and system.

BRIEF DESCRIPTION OF THE DRAWINGS

Without limiting the scope of the biodegradable lawn waste collection system as disclosed herein and referring now to the drawings and figures.

Figure 1:
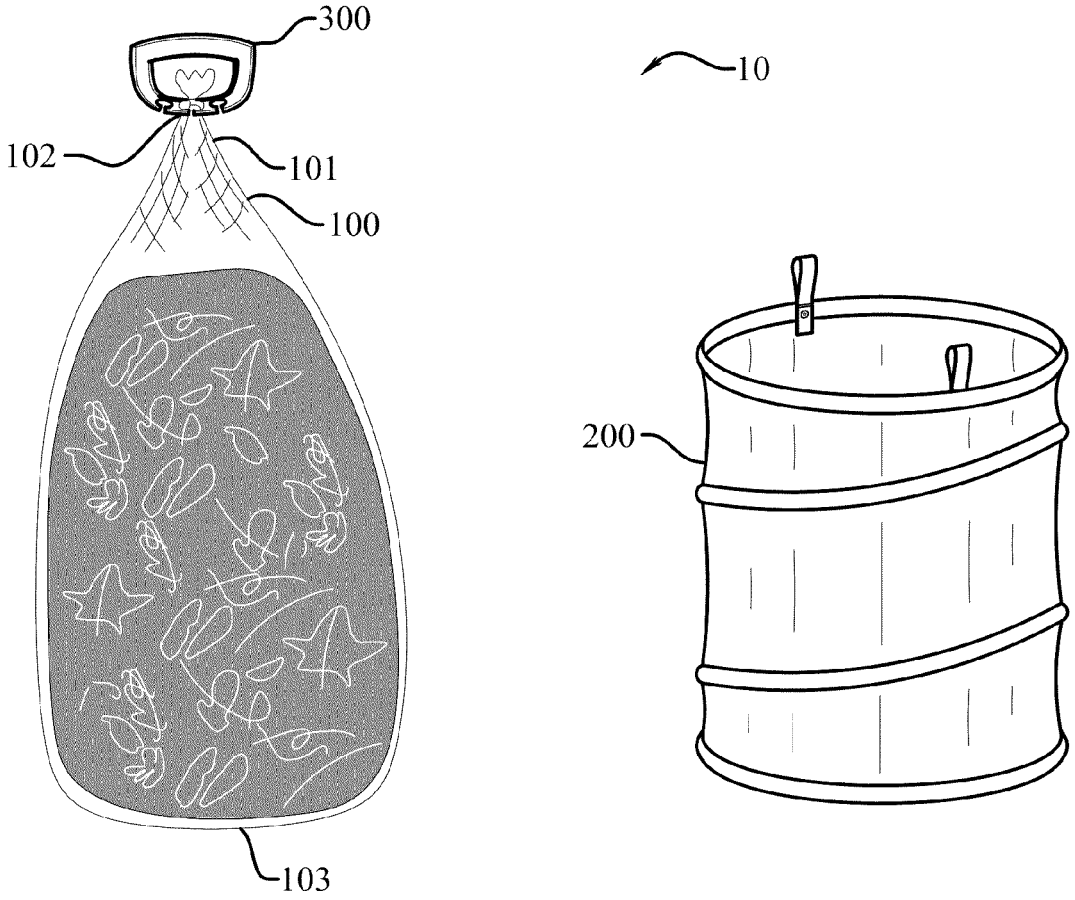
FIG. 1 shows an elevation view of embodiments of components of a biodegradable lawn waste collection system, not to scale.

These drawings are provided to assist in the understanding of the exemplary embodiments of the biodegradable lawn waste collection system as described in more detail below and should not be construed as unduly limiting the disclosure herein. In particular, the relative spacing, positioning, sizing and dimensions of the various elements illustrated in the drawings are not drawn to scale and may have been exaggerated, reduced or otherwise modified for the purpose of improved clarity. Those of ordinary skill in the art will also appreciate that a range of alternative configurations have been omitted simply to improve the clarity and reduce the number of drawings.

DETAILED DESCRIPTION OF THE INVENTION

The presently disclosed biodegradable lawn waste collection system (10) enables a significant advance in the state of the art. The preferred embodiments of the system (10) accomplish this by new and novel arrangements of elements and methods that are configured in unique and novel ways and which demonstrate previously unavailable but preferred and desirable capabilities. The description set forth below in connection with the drawings is intended merely as a description of the presently preferred embodiments of the system (10), and is not intended to represent the only form in which the system (10) may be constructed or utilized. The description sets forth the designs, functions, means, and methods of implementing the system (10) in connection with the illustrated embodiments. It is to be understood, however, that the same or equivalent functions and features may be accomplished by different embodiments that are also intended to be encompassed within the spirit and scope of the claimed system (10).

With reference generally to FIGS. 1-20, a biodegradable lawn waste collection system (10) is shown. The biodegradable lawn waste collection system (10) is designed and configured to allow users to easily and efficiently collect and dispose of all types of lawn waste or other wastes having a high moisture content. Moreover, the biodegradable lawn waste collection system (10) provides an environmentally friendly alternative to the ubiquitous paper lawn bag.

Referring now to FIG. 1, the biodegradable lawn waste collection system (10) generally includes a waste receiver (100), a shaping insert (200), and a handle (300). Each component of the biodegradable lawn waste collection system (10) will be described in greater detail below.

The first component of the biodegradable lawn waste collection system (10) is the waste receiver (100). As seen in FIG. 1, the waste receiver (100) includes a mesh structure (101) having a filling end (102) and a sealing end (103). As used throughout this specification, the term mesh structure (101) refers to a structure having openings or holes throughout the structure at regular or irregular intervals. Generally, the mesh structure (101) has an open area of about 90 percent or more, while the strands of the mesh structure (101) generally account for about 10 percent or less of the total mesh structure (101) area. The mesh structure (101) provides a number of benefits. For example, utilizing a mesh structure (101) results in a waste receiver (100) that is light and easy to carry, and also results in a smaller "carbon footprint" when compared to conventional paper lawn bags. The mesh structure (101) also efficiently distributes forces in the waste receiver (100) and creates a higher strength-to-weight ratio than found in paper lawn bags. Moreover, the mesh structure (101) imparts a natural "rip stop" feature to the waste receiver (100), which helps prevent a rip from propagating throughout the mesh structure (101). Still another important benefit of the mesh structure (101) is that it allows off-gassing or ventilation of wet lawn waste that has begun decomposing. Moreover, the mesh structure (101) also allows a considerable amount of moisture to drain out of the waste receiver (100). This feature also reduces the noxious odors that typically accompany wet stagnant waste or waste that has begun decomposing. The mesh structure (101) also gives composting facilities the ability to visually examine the contents of the waste receiver (100) for prohibited items, such as glass and metal objects, without having to open or touch the waste receiver (100). Still further, the mesh structure (101) allows undesirable materials such as fine dirt, dust, and small rocks or stones to be sifted out of the mesh structure (101) before being added to a compost pile. For example, the individual cells created by the strands of the mesh structure (101) may have approximate dimensions of ½ inch long by ¼ inch wide, which would allow fine materials to sift out. Larger cell dimensions may be provided to allow larger materials to sift out, but thicker strands must be utilized.

The mesh structure (101) of the waste receiver (100) may be produced in a number of forms. By way of example only, the mesh structure (101) may be an extruded tubular mesh, a woven tubular mesh, or a woven stitched mesh, just to name a few. Moreover, the mesh structure (101) of the waste receiver (100) may be formed as a planar sheet or as an elongate tube. Preferably, the mesh structure (101) of the waste receiver (100) is formed as an elongate tube. An elongate tube form allows the waste receiver (100) to be easily secured at the sealing end (103) to enable the waste receiver (100) to hold lawn waste. By way of example, and not limitation, the sealing end (103) may be secured by a number of methods, such as heat staking, heat sealing, ultrasonic welding, a mechanical fastener (e.g., a clip or tie), a cinch, or by tying a knot in the waste receiver (100) itself near the sealing end (103), just to name a few. Further, the mesh structure (101) may be produced with virtually any length. This provides an opportunity to produce the mesh structure (101) with a standard pre-cut length that corresponds to one waste receiver (100), or to produce the mesh structure (101) with an uncut length that corresponds to multiple waste receivers (100), which gives the end user the ability to create a waste receiver (100) with a user specified length.

Many lawn waste removal and collection services require the waste receiver (100) to be ground up along with the lawn waste and added to a compost pile. Thus, the waste receiver (100) must be biodegradable for proper disposal. The waste receiver (100) preferably comprises a thermoplastic material formed from a biodegradable polymer composition comprising polylactic acid (PLA). However, one with skill in the art will recognize that a number of biodegradable polymers, and blends thereof, may be utilized, including but not limited to, aliphatic-aromatic copolyesters, polyesteramides, polyhydroxyalkanoates (PHA), which include polyhydroxybutyrates (PHB), polyhydroxyvalerates (PHV), and polyhydroxybutyrate-hydroxyvalerate copolymers (PHBV), polycaprolactones, thermoplastic starch, polybutylene succinate (PBS), polybutylene succinate adipate (PBSA), and combinations thereof. Many of the commercially available biodegradable polymer compositions are suitable for use in composting applications.

It is important to make the distinction between biodegradable and compostable. Biodegradable plastic will degrade from the action of naturally occurring microorganisms, such as bacteria and fungi, over a long period of time. The amount of degradation depends on the material, the environmental conditions present, and the time period. Moreover, the degradation of biodegradable plastics can leave behind toxic residues.

On the other hand, compostable plastic is plastic which is capable of undergoing biological decomposition in a compost site as part of an available program, such that the plastic is not visually distinguishable and breaks down to carbon dioxide, water, inorganic compounds, and biomass, at a rate consistent with known compostable materials (e.g. cellulose), and leaves no toxic residue. In order for a plastic to be called compostable, generally three criteria need to be met: (1) it must biodegrade, or break down into carbon dioxide, water, biomass at the same rate as cellulose (paper); (2) it must disintegrate, in other words the material must be indistinguishable in the compost; and (3) the biodegradation does not produce any toxic material and the compost must support plant growth.

A plastic material therefore may be biodegradable but not compostable (that is, it breaks down too slowly to be called compostable or leaves toxic residue). The rate of biodegradation for different biocompostables is dependent upon the composition and thickness of the material as well as composting conditions. Commercial composting facilities grind the materials, turn over the piles and reach high temperatures, thus reducing the amount of time it takes to compost and, is thus, the recommended method for composting these products. Home composting rates are slower and can vary, depending on how frequently the pile is turned over, the moisture and material content and the temperature.

The term "biodegradable" used throughout this specification refers to materials that are biodegradable and compostable. Thus, references to biodegradable polymer compositions or biodegradable waste receivers (100) means that the materials meet the criteria set forth by the American Society for Testing and Materials (ASTM) in their publication ASTM D 5511 "Standard Test Method for Determining Anaerobic Biodegradation of Plastic Materials Under High-Solids Anaerobic-Digestion Conditions" and the criteria set forth in ASTM's publication ASTM D6400 "Standard Specification for Compostable Plastics," and other international standards generally aligned with these methods, such as the European Standardization Committee's EN13432.

The combination of having a mesh structure (101) and being formed of a thermoplastic material provides the waste receiver (100) with several advantages. One advantage is the flexibility of waste receiver (100). This flexibility allows the waste receiver (100) to be easily secured at the filling end (102) by tying a knot after lawn waste is introduced into the waste receiver (100). Similarly, the waste receiver (100) is capable of great expansion. In one embodiment, the waste receiver (100) has an expansion ratio of at least 3:1. As used herein, the expansion ratio is defined as the ratio of the expanded diameter of the waste receiver (100) to the initial non-expanded diameter of the waste receiver (100). As an example, a waste receiver (100) having an initial diameter of 3 inches and an expanded diameter of 30 inches would have an expansion ratio of 10:1.

Another advantage is that the waste receiver (100) has a very large capacity to weight ratio. The capacity to weight ratio is the ratio of the filling capacity of the waste receiver (100) (in gallons) to the weight of an empty waste receiver (100) (in pounds). In one particular embodiment, the waste receiver (100) has a capacity to weight ratio of at least 990 gallon/lb. Thus, a waste receiver (100) with a capacity to weight ratio of at least 990 gallon/lb could have an empty weight of 0.03 lbs with the ability to hold roughly 30 gallons of material.

Figure 3:
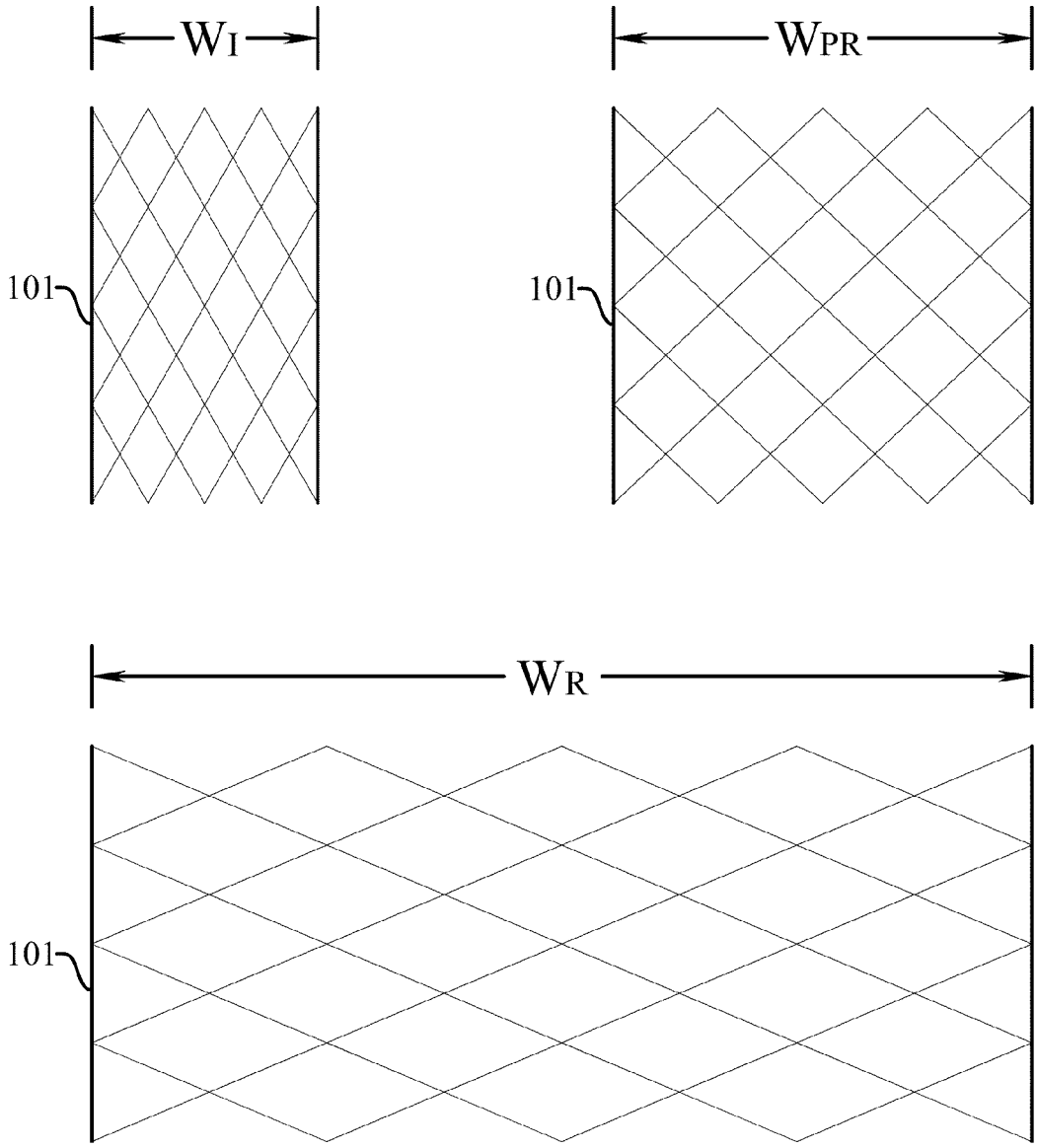
FIG. 3 shows embodiments of portions of a mesh structure of a waste receiver of the biodegradable lawn waste collection system, not to scale.

Typically, an extruded tubular mesh structure (101) is produced with a very long length so that it may be wrapped around a spool to provide for easy distribution. However, when used as a waste receiver (100), as noted above, the mesh structure (101) may have a standard pre-cut length, e.g., 54 inches, that corresponds to one waste receiver (100). When the extruded tubular mesh structure (101) is first produced it has an initial configuration including an initial width ($W_I$), an initial diameter ($D_I$), and an initial volume. The initial width ($W_I$), as seen in FIG. 3, is the width of the extruded tubular mesh structure (101) when laid flat. The initial diameter ($D_I$) is referred to as the largest diameter of a cylindrical object that can be introduced into the extruded tubular mesh structure (101) without substantially expanding the extruded tubular mesh structure (101). Similarly, the initial volume is the largest volume of a cylindrical object that can be introduced into the extruded tubular mesh structure (101) without substantially expanding the extruded tubular mesh structure (101). In many instances, the initial width ($W_I$), initial diameter ($D_I$), and initial volume are quite small making the extruded tubular mesh structure (101) difficult to manipulate with one's fingers. By way of example only and not limitation, the initial width ($W_I$) may be in the range of about ½ inch to about 2 inches. Similarly, by way of example only and not limitation, the initial diameter ($D_I$) may be in the range of about ¾ inch to about 3 inches. The initial volume may be expressed in terms of a volume per foot of the mesh structure (101). For example purposes only and not limitation, the initial volume may be in the range of about 5.3 cubic inches per foot to about 85 cubic inches per foot. Such a small initial width ($W_I$) and initial diameter ($D_I$) would inevitably lead to users trying to manipulate the extruded tubular mesh structure (101) with various tools that could damage the structural integrity of the extruded tubular mesh structure (101) that would render the extruded tubular mesh structure (101) unsuitable for use as a waste receiver (100).

Figure 2:
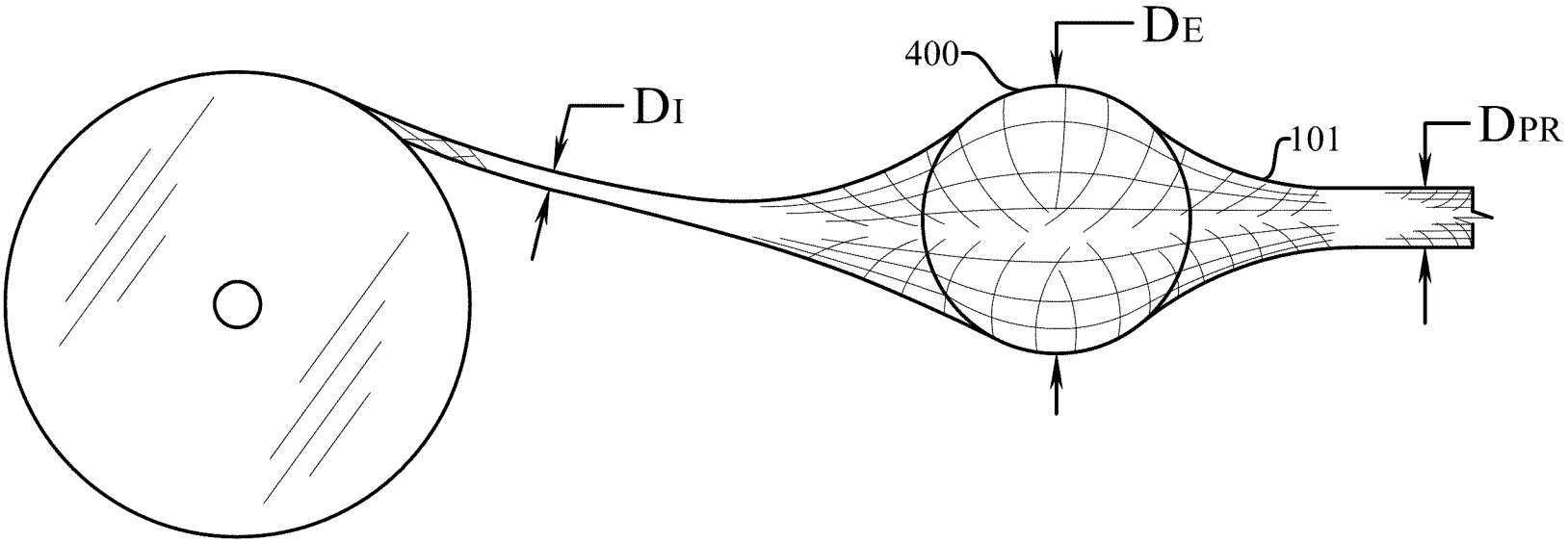
FIG. 2 illustrates an embodiment of a process for expanding a mesh structure of a waste receiver of the biodegradable lawn waste collection system, not to scale.

In order to provide an extruded tubular mesh structure (101) suitable for use as a waste receiver (100) it is advantageous to subject the extruded tubular mesh structure (101) to an expansion process, as seen in FIG. 2. The expansion process may be performed manually or it may be automated. The first step in the process is to introduce an expansion device (400) having an expansion diameter ($D_E$) within the extruded tubular mesh structure (101). By way of example and not limitation, the expansion device (400) may comprise a sphere, a round tipped cone, or any other smoothly rounded shape that will not become entangled with the extruded tubular mesh structure (101). After the expansion device (400) in inserted into the extruded tubular mesh structure (101), the extruded tubular mesh structure (101) may be pulled over the expansion device (400). Alternatively, the expansion device (400) may be pushed through the extruded tubular mesh structure (101). In one embodiment, the expansion device (400) has an expansion diameter ($D_E$) that is at least three times greater than the initial diameter ($D_I$). In another embodiment, the expansion device (400) has an expansion diameter ($D_E$) that is at least 10 times greater than the initial diameter ($D_I$). In a specific embodiment, the expansion device (400) comprises a sphere having an expansion diameter ($D_E$) of at least nine inches.

Subjecting the extruded tubular mesh structure (101) to an expansion process, such as shown in FIG. 2, causes some plastic deformation of the extruded tubular mesh structure (101) resulting in a new configuration, which is referred to herein as the pre-receiving configuration. As with the initial configuration, the pre-receiving configuration includes a pre-receiving width ($W_{PR}$), as seen in FIG. 3, a pre-receiving diameter ($D_{PR}$), and a pre-receiving volume. In one embodiment, the pre-receiving width ($W_{PR}$) is at least 50 percent greater than the initial width ($W_I$), the pre-receiving diameter ($D_{PR}$) is at least 50 percent greater than the initial diameter ($D_I$), and the pre-receiving volume is at least 50 percent greater than the initial volume. In other words, in this embodiment, the expansion process results in a pre-receiving configuration that is at least 50 percent greater than the initial configuration. In another embodiment, the pre-receiving width ($W_{PR}$) is at least three times greater than the initial width ($W_I$), the pre-receiving diameter ($D_{PR}$) is at least three times greater than the initial diameter ($D_I$), and the pre-receiving volume is at least three times greater than the initial volume. In other words, in this particular embodiment, the expansion process results in a pre-receiving configuration that is at least three times greater than the initial configuration.

As noted above, when the extruded tubular mesh structure (101) is in its initial configuration the extruded tubular mesh structure (101) is difficult to manipulate with one's fingers. However, after expansion to the pre-receiving configuration, the extruded tubular mesh structure (101) is easier to manipulate with one's fingers rendering it suitable for easy use with the shaping insert (200), which is discussed in more detail below.

In still a further embodiment, the extruded tubular mesh structure (101) may be processed to form an extruded planar sheet mesh structure (101). For example, after the extruded tubular mesh structure (101) undergoes the expansion process described above, the extruded tubular mesh structure (101) is subjected to a cutting process, which may be automated or manual, to form an extruded planar sheet mesh structure (101) for use as a waste receiver (100). Preferably, the extruded tubular mesh structure (101) is cut along the length of the mesh structure (101). In this embodiment, it is preferable for the expansion device (400) to have a much larger expansion diameter ($D_E$), such as about 18 inches to about 36 inches, to provide the extruded planar sheet mesh structure (101) with a greater width after undergoing the cutting process. After the cutting process, multiple planar sheet mesh structures (101) may be secured to one another, such as by heat fusing or ultrasonic welding, to form a large, integral planar sheet mesh structure (101). In use, the extruded planar sheet mesh structure (101) may be placed on the ground and a user may rake, sweep, or place lawn waste upon the extruded planar sheet mesh structure (101). After a suitable amount of the lawn waste is on the extruded planar sheet mesh structure (101), the user may gather the corners of the extruded planar sheet mesh structure (101) and secure them with a clip, twist-tie, or by forming a knot, and dispose of the lawn waste filled mesh structure (101) accordingly.

Because the waste receiver (100) is designed to ultimately end up as compost material, there may be a desire to form the waste receiver (100) with a color that somewhat blends with the other compost material. In most instances, the compost material will have a brown or black, relatively dark appearance. In one particular embodiment, the waste receiver (100) is formed with a color selected from the group consisting of: red, orange, yellow, green, blue, violet, black, and combinations thereof, wherein the color has an L* value that is less than or equal to 60 on the CIELAB color measurement scale. The CIELAB color space has three dimensions or coordinates: L*, a*, and b*, where the L* coordinate represents lightness, which is related to the cube root of the relative luminance of the object to the luminance of a "specified white object." The lightness value L* ranges from zero (0), which indicates black, to 100, which indicates white. The a* coordinate indicates the color's position between red/magenta and green. A negative a* value represents green and a positive a* value represents magenta. The b* coordinate indicates the position between the yellow (positive) and the blue (negative). The L* value and CIELAB color space, as well as CIELUV, CIELCH and other color spaces are known in the art.

Another well known color space is the Munsell color system. The Munsell system is based on three color characteristics: hue, value (lightness or darkness), and chroma (the "purity" of the color). For example, a relatively dark brown color could be represented by the Munsell system as 5Y 1/2 (a Munsell color), with 5Y meaning the color in the middle of the yellow hue band, 1/meaning a low lightness, and a chroma of 2. In one embodiment, the waste receiver (100) may have a hue in a range between about 1R and about 10Y, which includes the red hue, the red-yellow hue, and the yellow hue, and a value in a range between about 0 and about 5.

Figure 21:
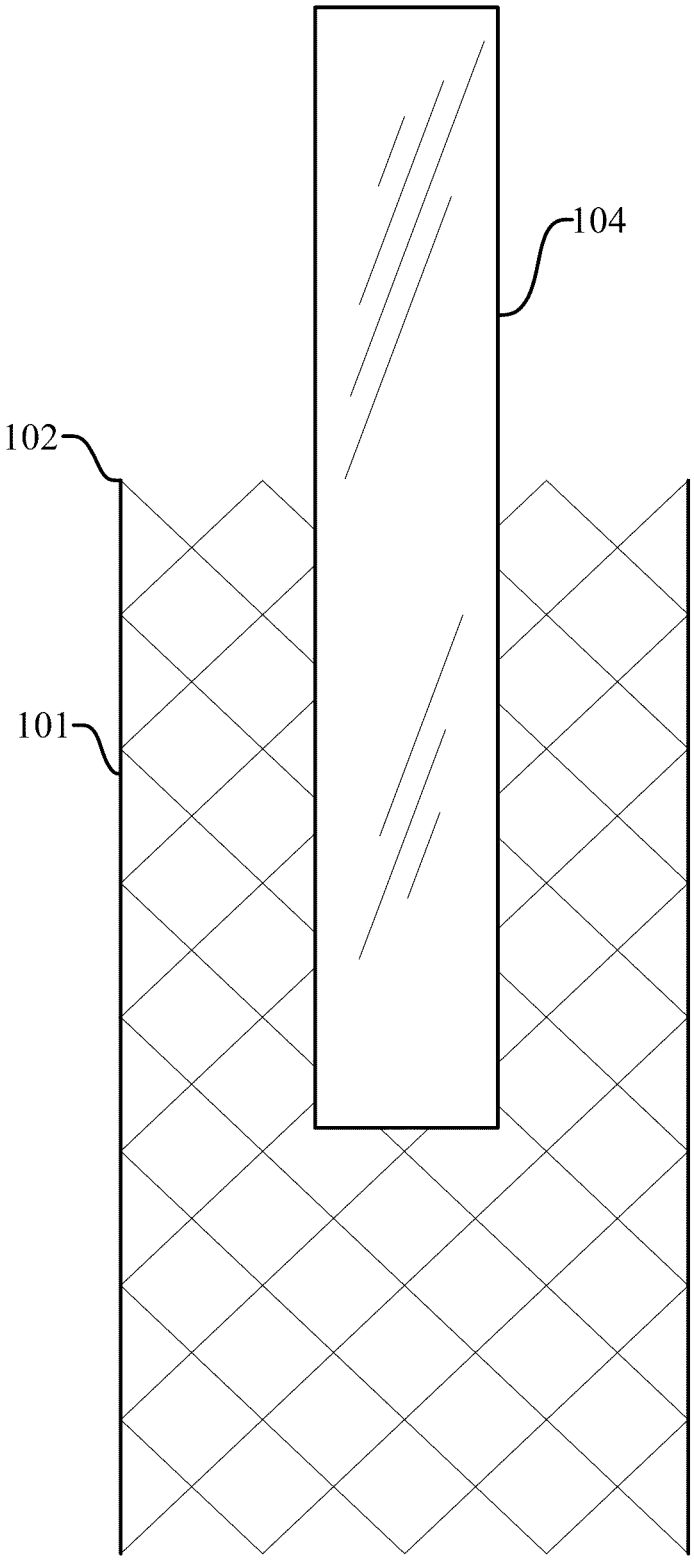
FIG. 21 shows an embodiment of a mesh structure with an embodiment of a gripping tab secured to the mesh structure, not to scale.
Figure 22:
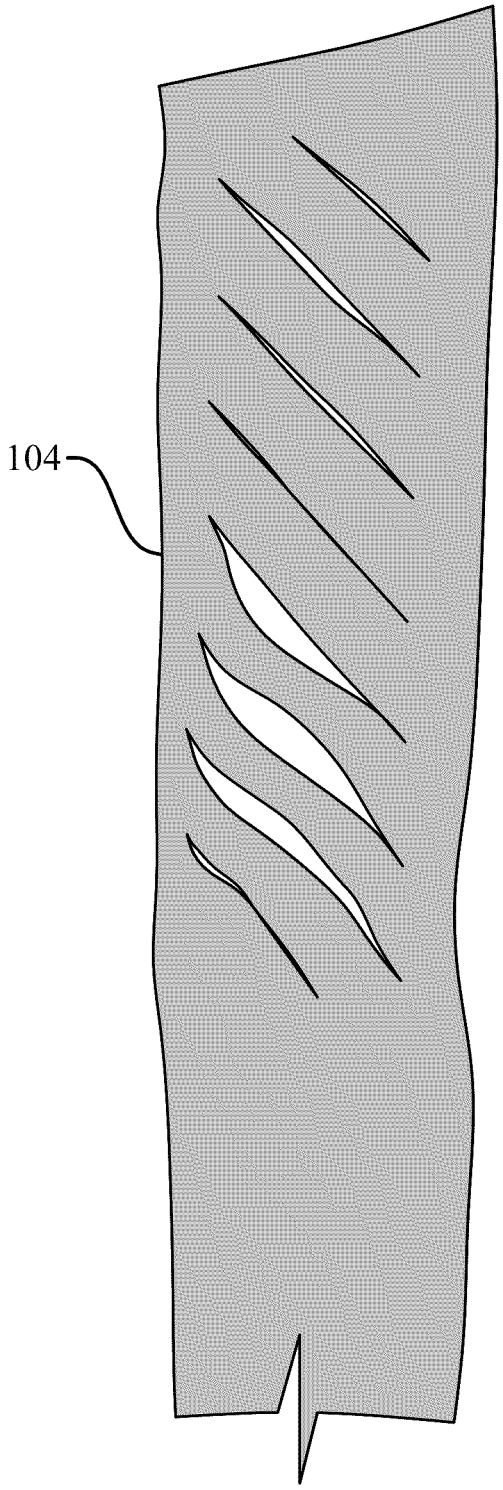
FIG. 22 shows an embodiment of a gripping tab.

In still another embodiment, the waste receiver (100) includes a gripping tab (104), as seen in FIG. 21. The gripping tab (104) helps the user in manipulating the waste receiver (100). In addition, the gripping tab (104) provides surfaces for displaying various indicia, such as trademarks and product information. The gripping tab (104) is configured to be secured to the filling end (102) of the waste receiver (100). Preferably, the gripping tab (104) is formed of a compostable material, such as paper, and is secured to the filling end (102) with virtually any type of bioadhesive, which are known in the art. Moreover, the gripping tab (104) material is configured to be flexible such that it does not interfere with the user's ability to secure the filling end (102), such as by tying a knot. Preferably, the gripping tab (104) is secured to the filling end (102) such that it extends at least one inch beyond the filling end (102). The gripping tab (104) may be formed as a long rectangle that is coated with bioadhesive on one surface such that folding the rectangle in half places two surfaces coated with bioadhesive in direct opposing relationship to one another, which may then be secured to the mesh structure (101) at the filling end (102). To ensure adequate adhesion to the mesh structure (101) of the waste receiver (100), the gripping tab (104) may be formed with slits, as seen in FIG. 22. The slits allow portions of the gripping tab (104) to better conform to the individual strands of the mesh structure (101), which reduces void areas that in turn provides a greater surface area for the two surfaces coated with bioadhesive to bond.

Referring now generally to FIGS. 4-16, the next component of the biodegradable lawn waste collection system (10) is a shaping insert (200). The shaping insert (200) is configured for removable reception within the filling end (102) of the waste receiver (100), as illustrated in FIG. 12. The shaping insert (200) provides the waste receiver (100) with rigidity and stability when filling the waste receiver (100) with lawn waste. Moreover, the shaping insert (200) allows the filling end (102) of the waste receiver (100) to remain open during the filling process. The shaping insert (200) also enables the waste receiver (100) to be positioned on its side so that lawn waste does not have to be picked up and dropped into the waste receiver (100). Additionally, when the waste receiver (100) is on its side, a user may use the waste receiver (100) as a scoop to collect lawn waste. After a user fills the waste receiver (100) to a desired level with lawn waste, the user may simply remove the shaping insert (200) and secure the filling end (102) to prepare the waste receiver (100) for disposal.

To aid in the filling of the waste receiver (100), the shaping insert (200) may be sized such that a user will not overfill the waste receiver (100) with lawn waste. For example, during the filling process, when the lawn waste reaches a level that is even with the top of the shaping insert (200), this would indicate that the waste receiver (100) is full and that no additional lawn waste should be added.

The shaping insert (200) may be formed with a waterproof material or may include a coating to render the shaping insert (200) waterproof. By using waterproof materials, the shaping insert (200) may be used in connection with wet lawn waste without affecting the structural integrity of the shaping insert (200).

In one embodiment, the shaping insert (200) comprises a planar substrate. The planar substrate may comprise various materials such as thermoplastics, foams, or cardboard, just to name a few. Preferably the planar substrate has a substantially rectangular shape with rounded corners. The rounded corners help ensure that the planar substrate will not become entangled with the mesh structure (101) of the waste receiver (100), thus facilitating reception of the planar substrate into the waste receiver (100). The planar substrate may also include a fastening device to removably secure a first end of the planar substrate to a second end of the planar substrate directly opposite the first end to form a tubular configuration. The term "tubular configuration," as used herein, refers to a substantially vertical, hollow conduit having a closed perimeter of virtually any shape that is open at its two ends. For example, the fastening device may comprise a tongue-and-groove type connection, hook-and-loop fasteners, or snap fasteners, just to name a few. The fastening device allows the planar substrate to retain a tubular configuration to facilitate removable reception within the filling end (102) of the waste receiver (100). In another embodiment, the shaping insert (200) may comprise a planar substrate having elastic panels. The elastic panels allow the shaping insert (200) to occupy less storage space, and also allow the shaping insert (200) to expand when used in the waste receiver (100).

Figure 4:
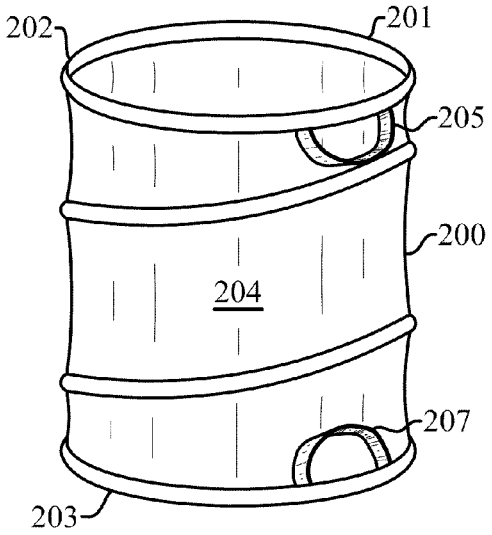
FIG. 4 shows an embodiment of a shaping insert of the biodegradable lawn waste collection system, not to scale.
Figure 5:
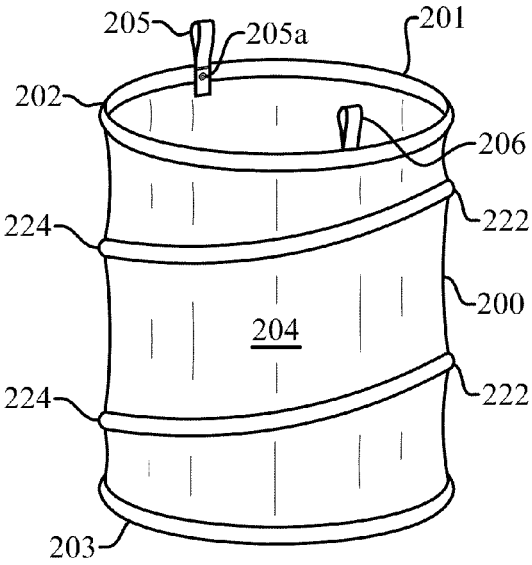
FIG. 5 shows an embodiment of a shaping insert of the biodegradable lawn waste collection system, not to scale.
Figure 6:
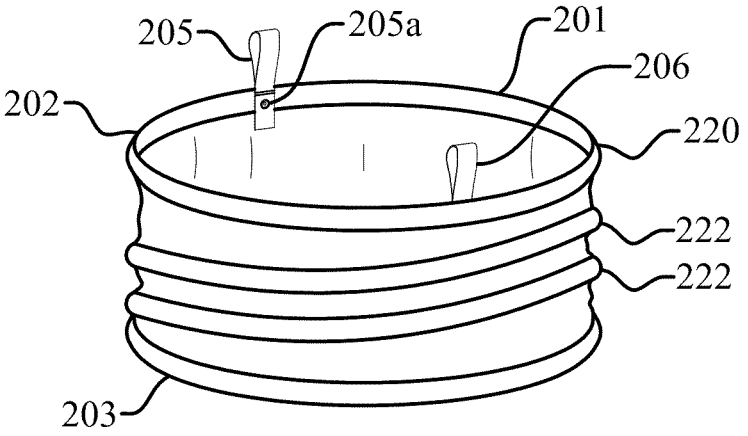
FIG. 6 shows an embodiment of a shaping insert of the biodegradable lawn waste collection system, not to scale.
Figure 7:
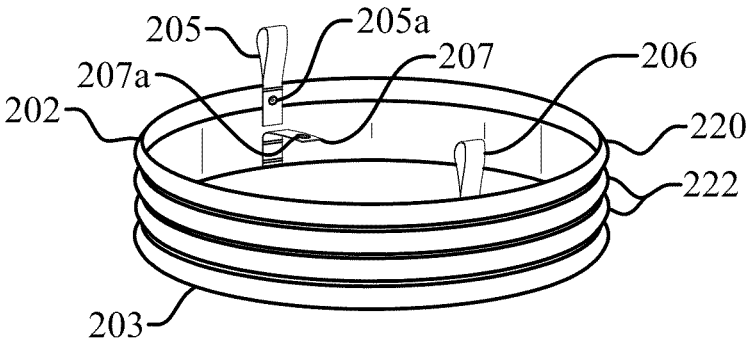
FIG. 7 shows an embodiment of a shaping insert of the biodegradable lawn waste collection system, not to scale.

Referring now to FIGS. 4 and 5, in another embodiment, the shaping insert (200) has a shaping insert perimeter (201), a shaping insert proximal end (202), a shaping insert distal end (203), and a continuous sidewall (204) extending between the shaping insert proximal end (202) and the shaping insert distal end (203) such that the shaping insert (200) has a tubular configuration. The shaping insert perimeter (201) may have a number of geometric configurations, such as circular, triangular, square, and rectangular, just to name a few. Preferably, for embodiments having a non-circular shaping insert perimeter (201), the straight edges of the perimeter (201) are joined to one another by a rounded edge.

The shaping insert (200) is configured with unique relationships with respect to the waste receiver (100), particularly with respect to the extruded tubular mesh structure (101) initial configuration and pre-receiving configuration, and more particularly with respect to the initial diameter ($D_I$) and the pre-receiving diameter ($D_{PR}$). For example, in one particular embodiment the shaping insert (200) includes a circular shaping insert perimeter (201) formed with a radius that is at least 50 percent greater than the pre-receiving diameter ($D_{PR}$). Such an embodiment ensures that the shaping insert (200) may be easily inserted into the waste receiver (100) without damaging the structural integrity of the waste receiver (100). In another embodiment, the shaping insert (200) has a non-circular shaping insert perimeter (201) formed with rounded corners, with each rounded corner having a radius of curvature that is greater than the initial diameter ($D_I$). Still further, in another embodiment, the non-circular shaping insert perimeter (201) is formed with rounded corners, with each rounded corner having a radius of curvature that is greater than the initial diameter ($D_I$), but less than the pre-receiving diameter ($D_{PR}$). This embodiment ensures that a rounded corner of the non-circular shaping insert perimeter (201) is capable of easy insertion into the waste receiver (100), but is not so small so as to become entangled with the mesh structure (101), which could damage the structural integrity of the mesh structure (101) making it unfit for use as a waste receiver (100).

In one embodiment, the shaping insert (200) comprises a collapsible tube (220), as seen in FIGS. 6-9. The collapsible tube (220) may be collapsible vertically, horizontally, transversely, radially, and combinations thereof. By way of example only, and not limitation, the collapsibility of the collapsible tube (220) may be provided by hinges, spring-coils (222), torsion springs, wire frame members designed with a biasing configuration, or areas of reduced strength to facilitate collapsing.

Figure 11:
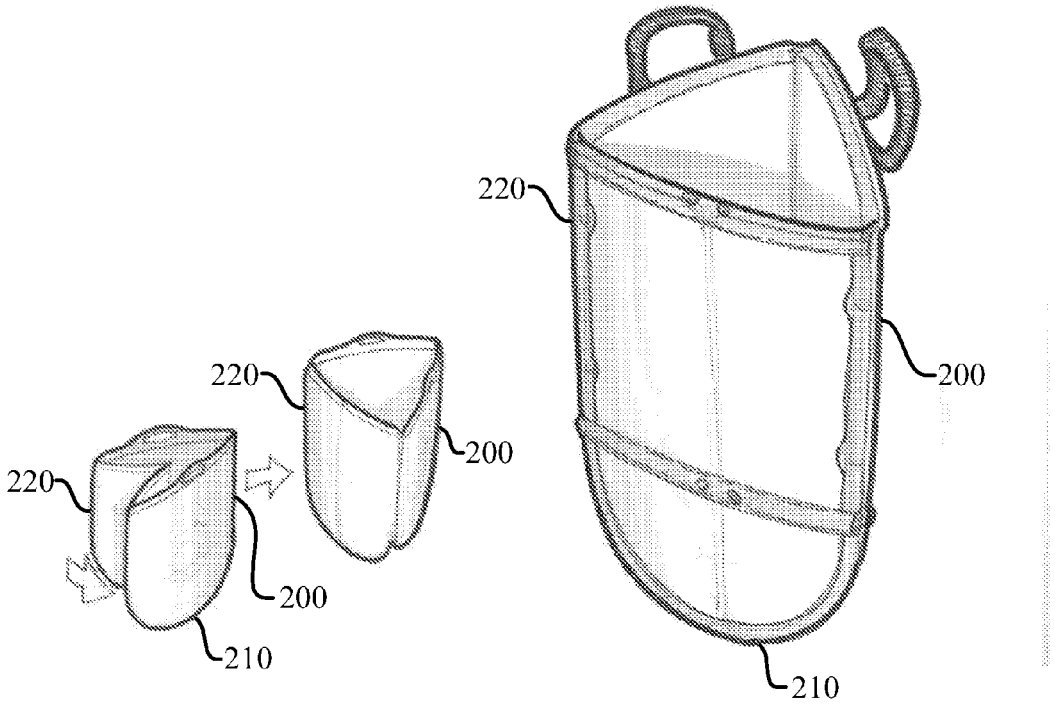
FIG. 11 shows an embodiment of a shaping insert of the biodegradable lawn waste collection system, not to scale.
Figure 12:
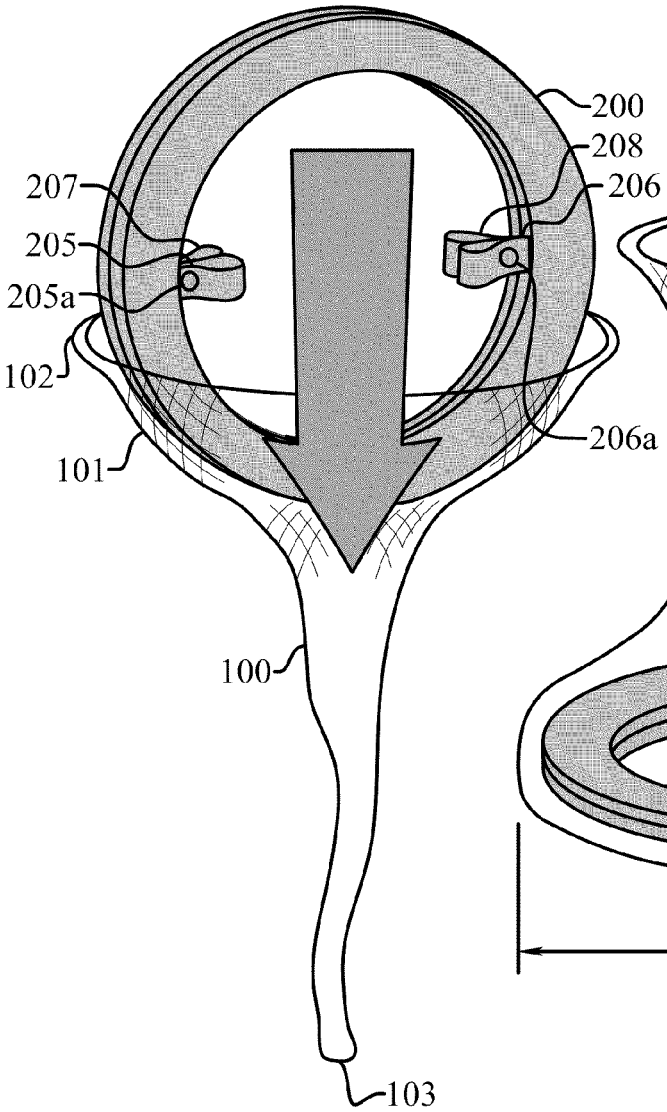
FIG. 12 shows an embodiment of a shaping insert in a storage position being inserted into an embodiment of a waste receiver, not to scale.

Moreover, it is preferable for the collapsible tube (220) to have a rounded insertion edge (210), as seen in FIG. 11. In this particular embodiment, the collapsible tube (220) is formed with a triangular shaping insert perimeter (201) and is collapsible transversely such that the collapsible tube (220) assumes a relatively flat orientation that places the rounded insertion edge (210) in a condition suitable for inserting into the waste receiver (100). A rounded insertion edge (210) protects the structural integrity of the waste receiver (100) by eliminating sharp edges that could become entangled with the mesh structure (101) of the waste receiver (100). Moreover, the rounded insertion edge (210) promotes a reduced friction cooperation between the shaping insert (200) and the waste receiver (100) to facilitate insertion of the shaping insert (200) within the waste receiver (100). In a particular embodiment, the rounded insertion edge (210) is formed with a radius of curvature that is at least 50 percent greater than the pre-receiving diameter ($D_{PR}$), but is less than 5 times greater than the pre-receiving diameter ($D_{PR}$). A shaping insert (200) with a rounded insertion edge (210) having a radius of curvature within this range facilitates reception of the shaping insert (200) within the waste receiver (100), but is not so large that insertion of the shaping insert (200) into the waste receiver (100) becomes unmanageable.

Figure 8:
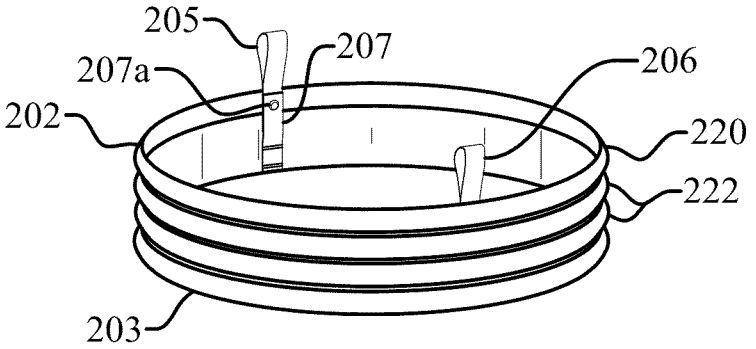
FIG. 8 shows an embodiment of a shaping insert of the biodegradable lawn waste collection system, not to scale.
Figure 9:
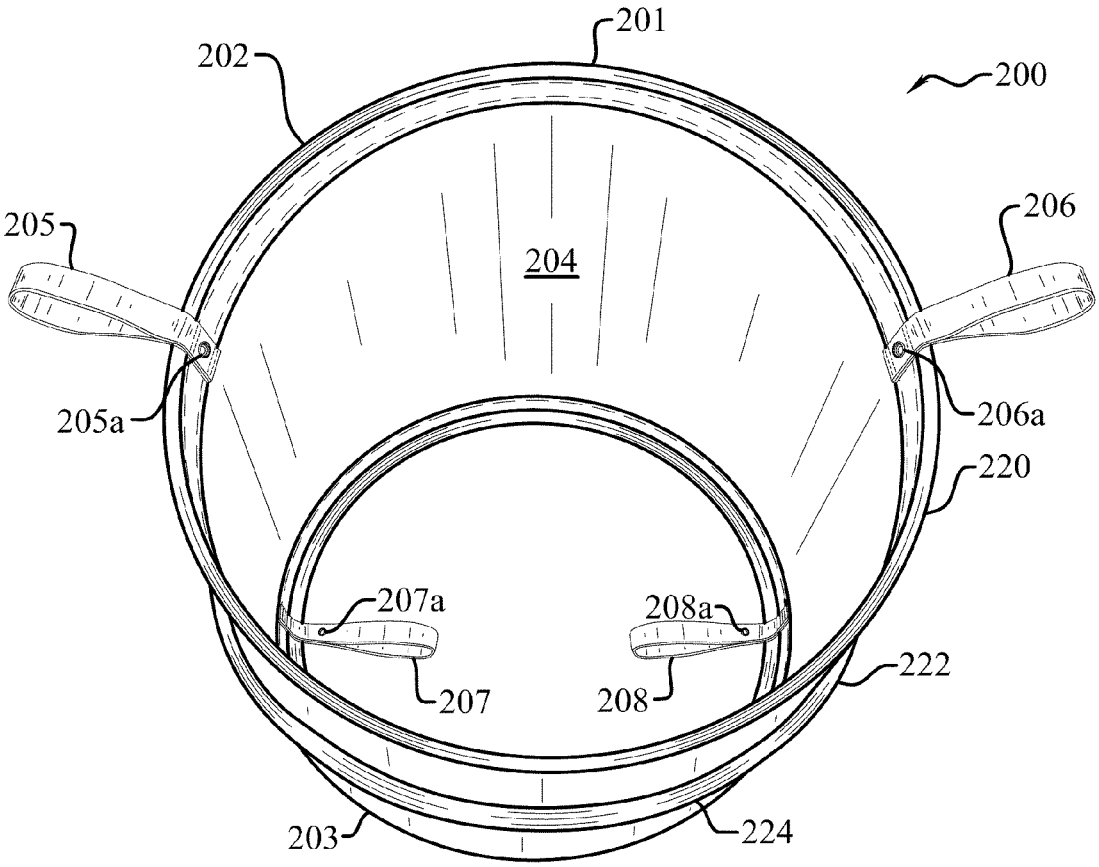
FIG. 9 shows a top perspective view of an embodiment of a shaping insert of the biodegradable lawn waste collection system, not to scale.
Figure 10:
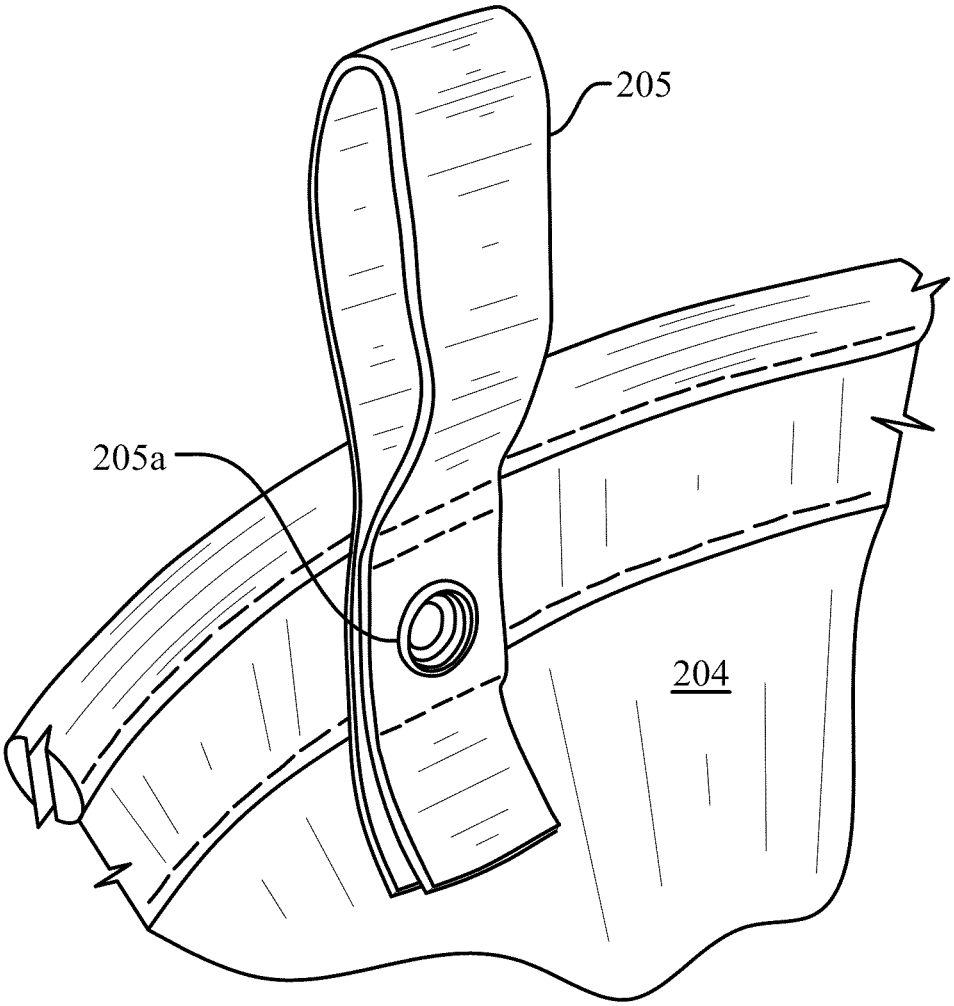
FIG. 10 shows a perspective view of a portion of an embodiment of a shaping insert of the biodegradable lawn waste collection system, not to scale.
Figure 13:
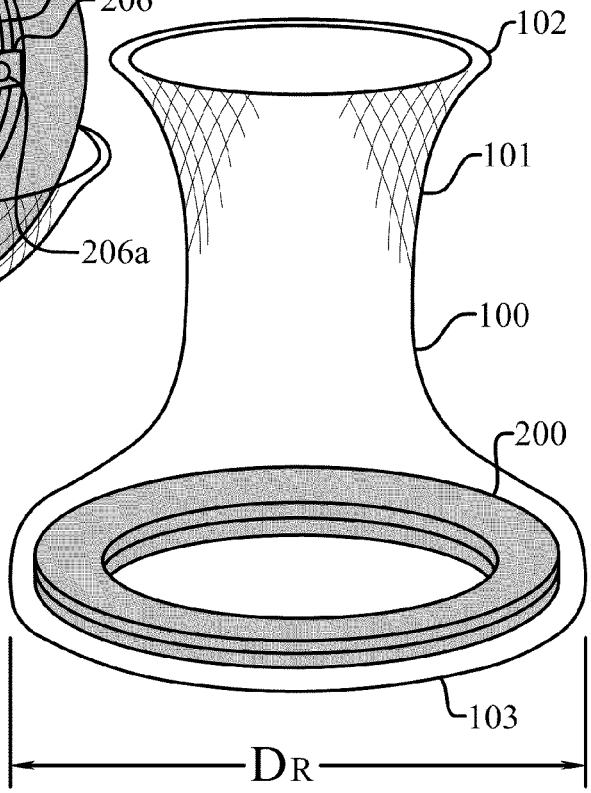
FIG. 13 shows an embodiment of a shaping insert in a storage position after it has been inserted within an embodiment of a waste receiver, not to scale.
Figure 14:
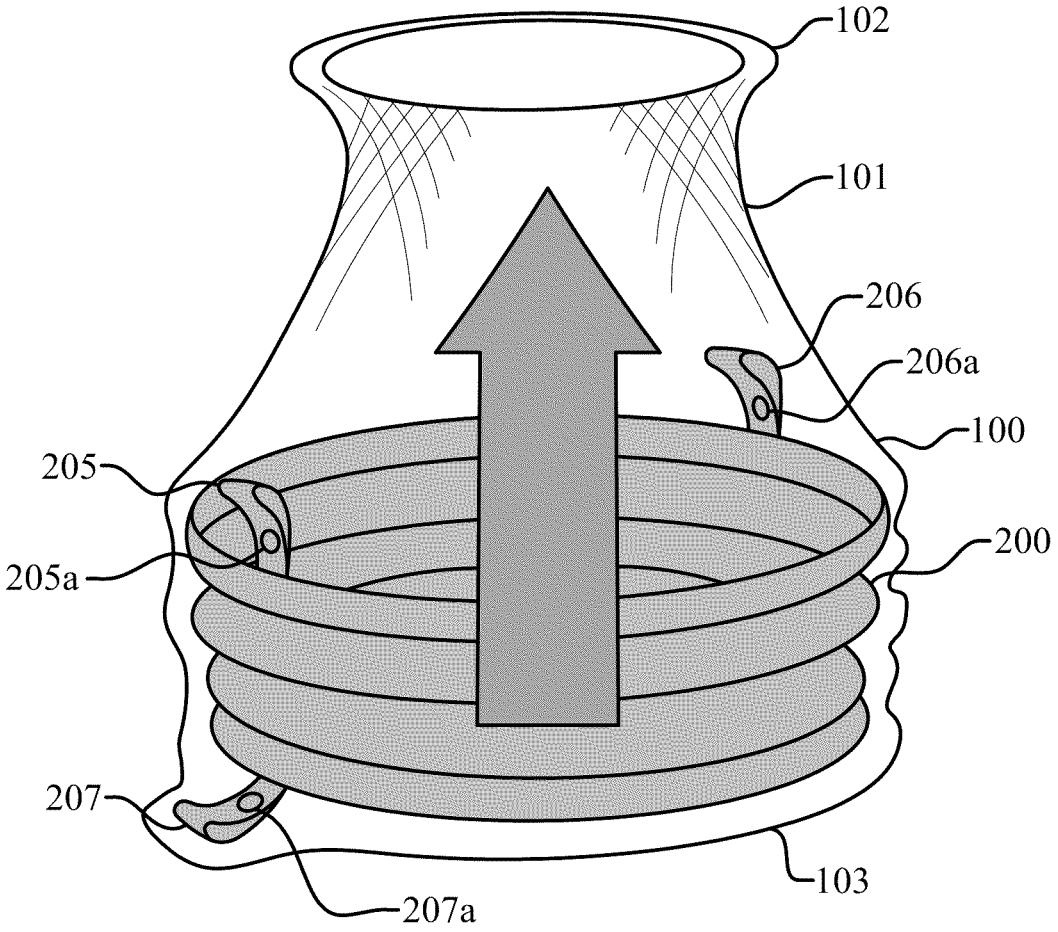
FIG. 14 shows an embodiment of a shaping insert moving to an expanded position in an embodiment of a waste receiver, not to scale.
Figure 15:
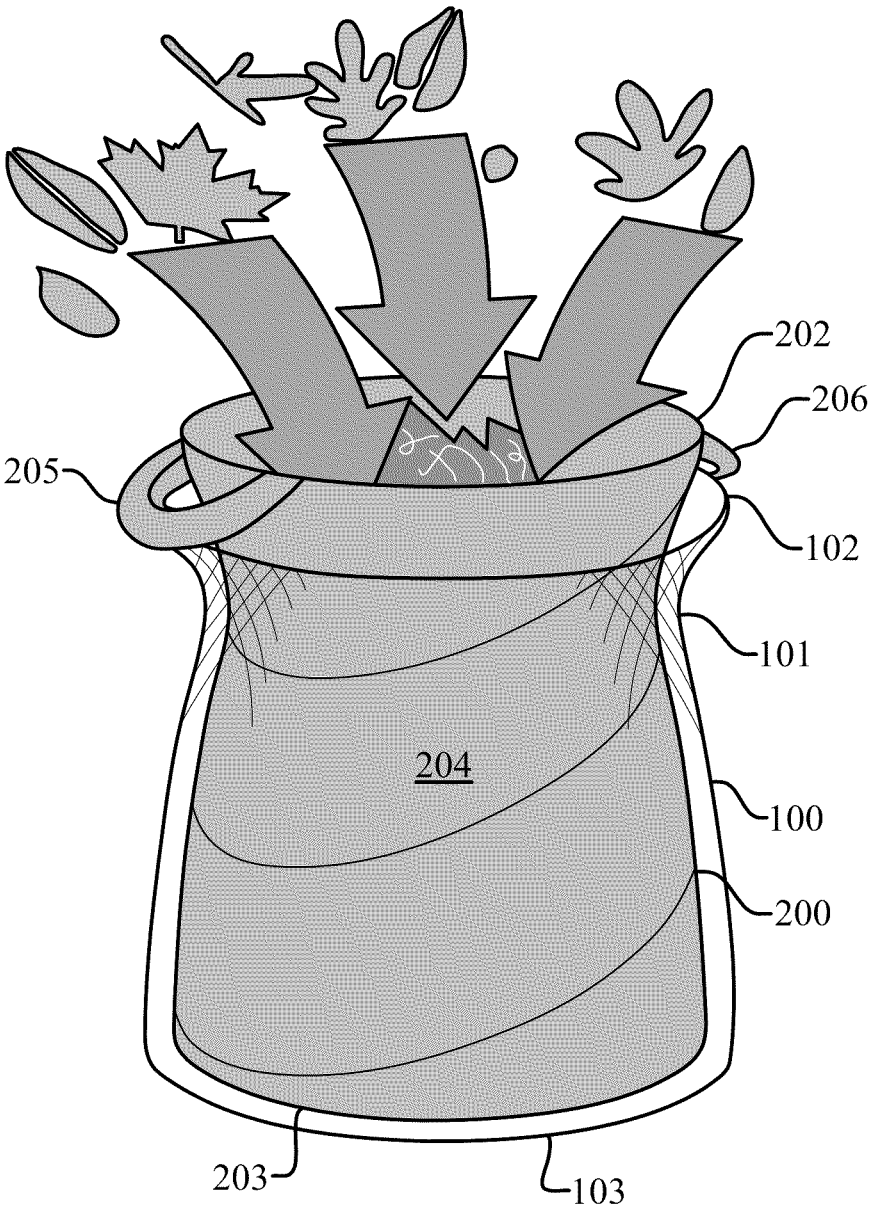
FIG. 15 shows an embodiment of a shaping insert in an expanded position in an embodiment of a waste receiver, not to scale.

In a particular embodiment, seen in FIG. 9, the shaping insert (200) has a circular shaping insert perimeter (201) and comprises a collapsible tube (220) having a spring-coil (222) secured to the collapsible tube (220). To protect the spring-coil (222), a sheath (224) may be provided to enclose the spring-coil (222). The spring-coil (222) tends to bias the collapsible tube (220) from a storage position to an expanded position, which is shown in FIGS. 13-15. The collapsible tube (220) may include storage fasteners, such as hook-and-loop fasteners, snap fasteners, magnets, or tie-downs to retain the collapsible tube (220) in the storage position, as seen in FIG. 8. When in the storage position, a user may insert the collapsible tube (220) into the filling end (102) of the waste receiver (100), as seen in FIG. 12. After the collapsible tube (220) is placed into the waste receiver (100), the user may release the storage fasteners to allow the collapsible tube (220) to transition to the expanded position, as shown in FIGS. 14 and 15. In one embodiment, when the collapsible tube (220) moves to the expanded position, the mesh structure (101) remains resilient and in tension such that the mesh structure (101) remains snug against the collapsible tube (220) and exerts a compressive force against the collapsible tube (220). The compressive force allows the mesh structure (101) to support its own weight, and thus the waste receiver (100) will not collapse or simply slide off after the collapsible tube (220) moves to the expanded position inside of the waste receiver (100). After the collapsible tube (220) has transitioned to the expanded position with the waste receiver (100), the waste receiver (100) is now ready for use.

In one particular embodiment, the spring-coil (222) exerts a longitudinal force of about 2 lbs to about 10 lbs when transitioning from the storage position to the expanded position. Similarly, when the collapsible tube (220) having a spring-coil (222) is placed within a waste receiver (100), the spring-coil (222) exerts a transverse force of about 2 lbs to about 10 lbs on the mesh structure (101), which causes the mesh structure (101) to expand to the receiving configuration. These spring-coil (222) forces permit the collapsible tube (220) to overcome the longitudinal friction force and expansion force of the mesh structure (101). Such an embodiment permits the spring-coil (222) to fully expand within the mesh structure (101) with minimal involvement by the user. Moreover, the spring-coil (222) longitudinal force and transverse force are large enough to expand the mesh structure (101), but are not so large as to create difficulties or a safety hazard when a user compresses the collapsible tube (220) to the storage position. In one particular embodiment, the amount of longitudinal force is about 10 percent to about 30 percent of the transverse force. This provides a balanced amount of force that allows the spring-coil (222) to fully extend longitudinally, as well as transversely within the mesh structure (101).

In one embodiment, prior to inserting the shaping insert (200), i.e., the collapsible tube (220), within the waste receiver (100), the extruded tubular mesh structure (101) is in the pre-receiving configuration. After the shaping insert (200) is allowed to expand within the extruded tubular mesh structure (101), the expansion causes some degree of plastic deformation of the extruded tubular mesh structure (101) resulting in an additional configuration, which is referred to herein as the receiving configuration, as seen in FIGS. 13-15. As discussed above with respect to the initial configuration and the pre-receiving configuration, the receiving configuration includes a receiving width ($W_R$), which is best seen in FIG. 3, a receiving diameter ($D_R$), as seen in FIG. 13, and a receiving volume. In one embodiment, the pre-receiving diameter ($D_{PR}$) is at least 10 percent of the receiving diameter ($D_R$). This particular embodiment ensures that the mesh structure (101) has dimensions that allow a user to easily manipulate the mesh structure (101) with their fingers rendering it suitable for easy use with the shaping insert (200). In another embodiment, the pre-receiving diameter ($D_{PR}$) is no more than 40 percent of the receiving diameter ($D_R$). In still another embodiment, the pre-receiving diameter ($D_{PR}$) is within a range of about 10 percent of the receiving diameter ($D_R$) to about 40 percent of the receiving diameter ($D_R$). This embodiment provides a waste receiver (100) having a mesh structure (101) with dimensions that allow easy manipulation with one's fingers, but are not so large that the waste receiver (100) becomes awkward to use. In yet another embodiment, the receiving width ($W_R$) is at least three times greater than the pre-receiving width ($W_{PR}$), the receiving diameter ($D_R$) is at least three times greater than the pre-receiving diameter ($D_{PR}$), and the receiving volume is at least five times greater than the pre-receiving volume. In other words, in this embodiment, the mesh structure (101) is capable of expanding to a receiving configuration that is at least three times greater than the pre-receiving configuration. Such expansion is beneficial for increasing the volume of waste that can be collected, but it also facilitates efficient packaging of the waste receivers (100) by being able to package the waste receivers (100) in the smaller pre-receiving configuration.

In an alternative embodiment, the collapsible tube (220) may include a rigid collar. The rigid collar further facilitates the cooperation between the collapsible tube (220) and the waste receiver (100) by providing a lip onto which a user can secure the filling end (102) when the collapsible tube (220) is transitioned to the expanded position. In this embodiment, the collapsible tube (220) may be retained in the storage position by the cooperation of a loop or strap of material at the bottom of the collapsible tube (220) with a projection tab formed in the rigid collar. Alternatively, the rigid collar may be formed with a flexible wire handle that cooperates with the loop or strap of material to retain the collapsible tube (220) in the storage position.

In yet another embodiment, the shaping insert (200) may include an expandable lattice structure. The expandable lattice structure may be hinged in such a way that the shaping insert (200) is capable of expanding radially outward. This allows the shaping insert (200) to be easily inserted into the filling end (102) and subsequently expanded for use, as seen in FIG. 11.

Figure 16:
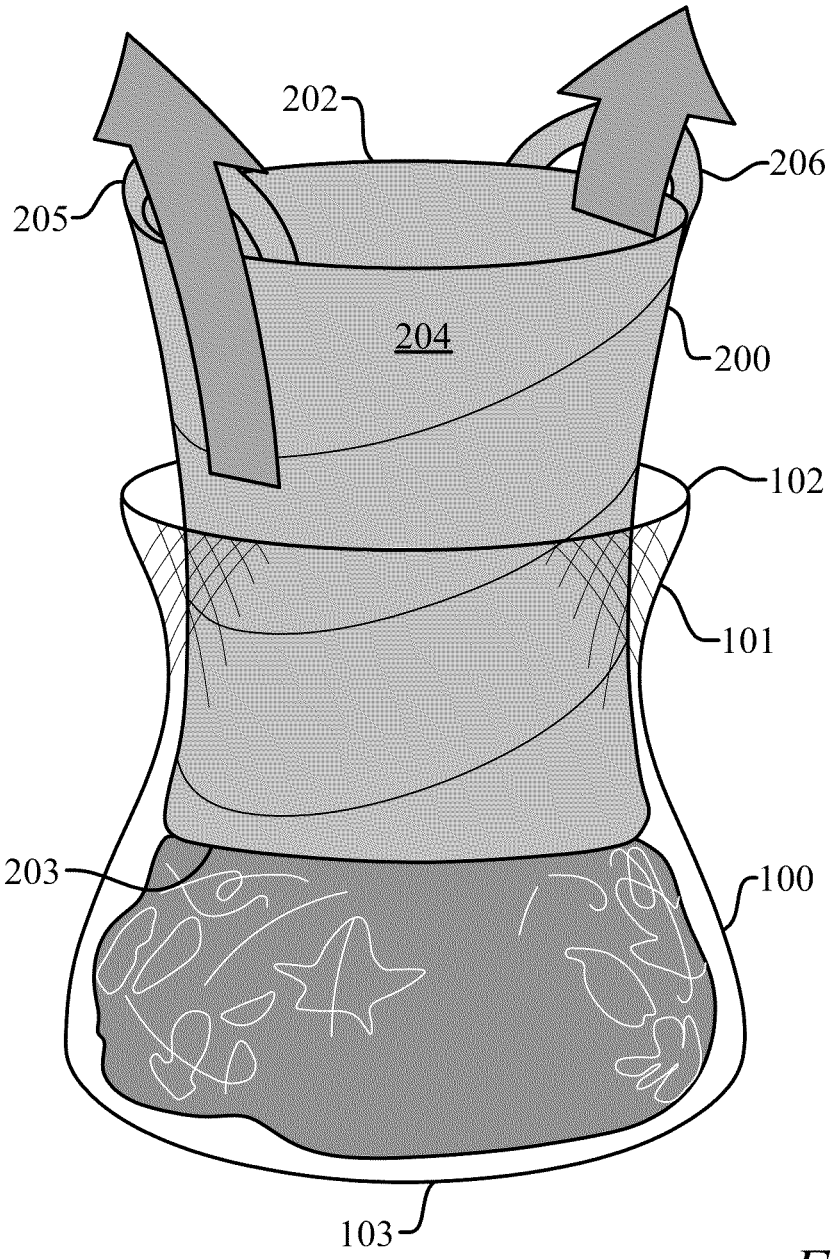
FIG. 16 shows an embodiment of a shaping insert in an expanded position being removed from an embodiment of a waste receiver, not to scale.

The shaping insert (200) may include handles to aid in removing the shaping insert (200) from the waste receiver (100), as seen in FIG. 16. In one embodiment, the shaping insert (200) includes a first proximal handle (205) secured to the shaping insert proximal end (202) and a second proximal handle (206) secured to the shaping insert proximal end (202) in direct opposing relationship to the first proximal handle (205). For example, for a shaping insert (200) having a circular shaping insert perimeter (201), the second proximal handle (206) would be positioned 180 degrees from the first proximal handle (205), as seen in FIG. 5. In this embodiment, the shaping insert (200) would be inserted within the waste receiver (100) such that the first and second proximal handles (205, 206) are adjacent the filling end (102). Thus, the first and second proximal handles (205, 206) facilitate removal of the shaping insert (200) from the waste receiver (100) after the waste receiver (100) has been filled with lawn waste. In the same way, the shaping insert (200) may include a first distal handle (207) secured to the shaping insert distal end (203) and a second distal handle (208) secured to the shaping insert distal end (203) in direct opposing relationship to the first distal handle (207). In this embodiment, the shaping insert (200) would be inserted within the waste receiver (100) such that the first and second distal handles (207, 208) are adjacent the filling end (102) to facilitate removal of the shaping insert (200) from the waste receiver (100). In a further embodiment, the shaping insert (200) includes first and second proximal handles (205, 206), as well as first and second distal handles (207, 208) as previously described, as illustrated in FIG. 9. This particular embodiment allows the shaping insert (200) to be inserted into the waste receiver (100) without regard for whether the shaping insert proximal end (202) or the shaping insert distal end (203) is positioned adjacent to the filling end (102); after all, in this embodiment a handle will always be adjacent to the filling end (102)

In still a further embodiment, the shaping insert (200) comprises a collapsible tube (220) with a spring-coil (222) secured to the collapsible tube (220) and further includes first and second proximal handles (205, 206) and first and second distal handles (207, 208), as described above, and seen in FIG. 9. In this particular embodiment, when the collapsible tube (220) is compressed to a storage position, the first distal handle (207) substantially aligns with the first proximal handle (205) and the second distal handle (208) substantially aligns with the second proximal handle (206), as shown in FIG. 8 with respect to the first distal handle (207) and the first proximal handle (205). As used here, the term "substantially aligns" means that a portion of each handle, e.g., first distal and first proximal handle (207, 205), are in the same vertical plane. This embodiment may further include a first proximal fastening device (205*a*) secured to a portion of the first proximal handle (205) and a first distal fastening device (207*a*) secured to a portion of the first distal handle (207), with the first distal fastening device (207*a*) configured for cooperative engagement with the first proximal fastening device (205*a*), as seen in FIG. 9. Similarly, this embodiment may include a second proximal fastening device (206*a*) secured to a portion of the second proximal handle (206) and a second distal fastening device (208*a*) secured to a portion of the second distal handle (208), with the second distal fastening device (208*a*) configured for cooperative engagement with the second proximal fastening device (206*a*), also seen in FIG. 9. By way of example only, and not limitation, the fastening devices (205*a*, 206*a*, 207*a*, 208*a*) may comprise cooperating hook-and-loop type fasteners or cooperating snap fasteners, just to name a couple. Thus, in this embodiment, when the collapsible tube (220) is compressed to the storage position, the first proximal handle (205) may be secured to the first distal handle (207) through the cooperative engagement of the first proximal and first distal fastening devices (205*a*, 207*a*), and the second proximal handle (206) may be secured to the second distal handle (208) through the cooperative engagement of the second proximal and second distal fastening devices (206*a*, 208*a*) to thereby retain the collapsible tube (220) in the storage position.

As seen in FIG. 12, in one embodiment, the fastening devices (205*a*, 206*a*, 207*a*, 208*a*) are secured to the first and second proximal handles (205, 206) and the first and second distal handles (207, 208) such that the resiliency of the spring-coil (222) places the engaged fastening devices (205*a*, 207*a* and 206*a*, 208*a*) in tension. This occurs, for example, when the fastening devices (205*a*, 207*a* and 206*a*, 208*a*) are located on the first and second proximal handles (205, 206) and the first and second distal handles (207, 208), as seen in FIG. 12. In this particular embodiment, the resiliency of the spring-coil (222) places a biasing force on the engaged fastening devices (205*a*, 207*a* and 206*a*, 208*a*), which may tend to cause the engaged fastening devices (205*a*, 207*a* and 206*a*, 208*a*) to disengage. However, in an alternative embodiment, the fastening devices (205*a*, 206*a*, 207*a*, 208*a*) are secured to the first and second proximal handles (205, 206) and the first and second distal handles (207, 208) such that the resiliency of the spring-coil (222) places the engaged fastening devices (205*a*, 207*a* and 206*a*, 208*a*) in shear. In one embodiment, to place the engaged fastening devices (205*a*, 207*a* and 206*a*, 208*a*) in shear, one part of the engaged fastening device (205*a*, 207*a* and 206*a*, 208*a*) is secured to a portion of the handle (205, 206, 207, 208) that is also secured to the continuous sidewall (204), seen well in FIG. 10 with respect to the first proximal fastening device (205*a*), while the other part of the engaged fastening device (205*a*, 207*a* and 206*a*, 208*a*) is secured to a portion of the handle (205, 206, 207, 208) that is not secured to the continuous sidewall (204), as seen in FIG. 9 with respect to the first and second distal fastening devices (207*a*, 208*a*). When the engaged fastening devices (205*a*, 207*a* and 206*a*, 208*a*) are in shear, a much greater force must be applied to separate the engaged fastening devices (205*a*, 207*a* and 206*a*, 208*a*) compared to when the engaged fastening devices (205*a*, 207*a* and 206*a*, 208*a*) are in tension. As a result of the shear force, it is much less likely that the fastening devices (205*a*, 207*a* and 206*a*, 208*a*) will become unintentionally disengaged.

In yet another embodiment, the shaping insert (200) incorporates handles at only one end, for example, at the shaping insert proximal end (202). In this embodiment, the first proximal handle (205) and the second proximal handle (206) may each include a pair of cooperating fastening devices secured to opposite sides of the handles (205, 206). Thus, when the shaping insert (200) is compressed, the handles (205, 206) may be wrapped around the compressed sides of the shaping insert (200) so that the pair of cooperating fastening devices on the first proximal handle (205) come into engagement and the pair of cooperating fastening devices on the second proximal handle (206) come into engagement to thereby retain the shaping insert (200) in the compressed storage position. It should be noted that this embodiment is equally applicable when applied to the shaping insert distal end (203).

Moreover, the shaping insert (200) may include a removable lid. For example, the removable lid may be attached to the shaping insert (200) via a zipper, snaps, or hook-and-loop fasteners. The removable lid allows the shaping insert (200) itself to be utilized as a storage container. The removable lid may be attached at the shaping insert proximal end (202), the shaping insert distal end (203), or at both ends (202, 203).

With reference now to FIGS. 17-20, the final component of the biodegradable lawn waste collection system (10) is a handle (300). The handle (300) is designed and configured to facilitate the transport of at least one waste receiver (100) containing lawn waste. As seen throughout FIGS. 17-20, the handle (300) includes at least one attachment port (310) for releasable attachment with the waste receiver (100).

The handle (300) preferably comprises a durable thermoplastic material. However, the handle (300) could be formed of wood, metal, or combinations of woods, metals, and plastics. Moreover, the handle (300) may include a foam material to provide cushioning to the hands and fingers of a user.

Figure 17:
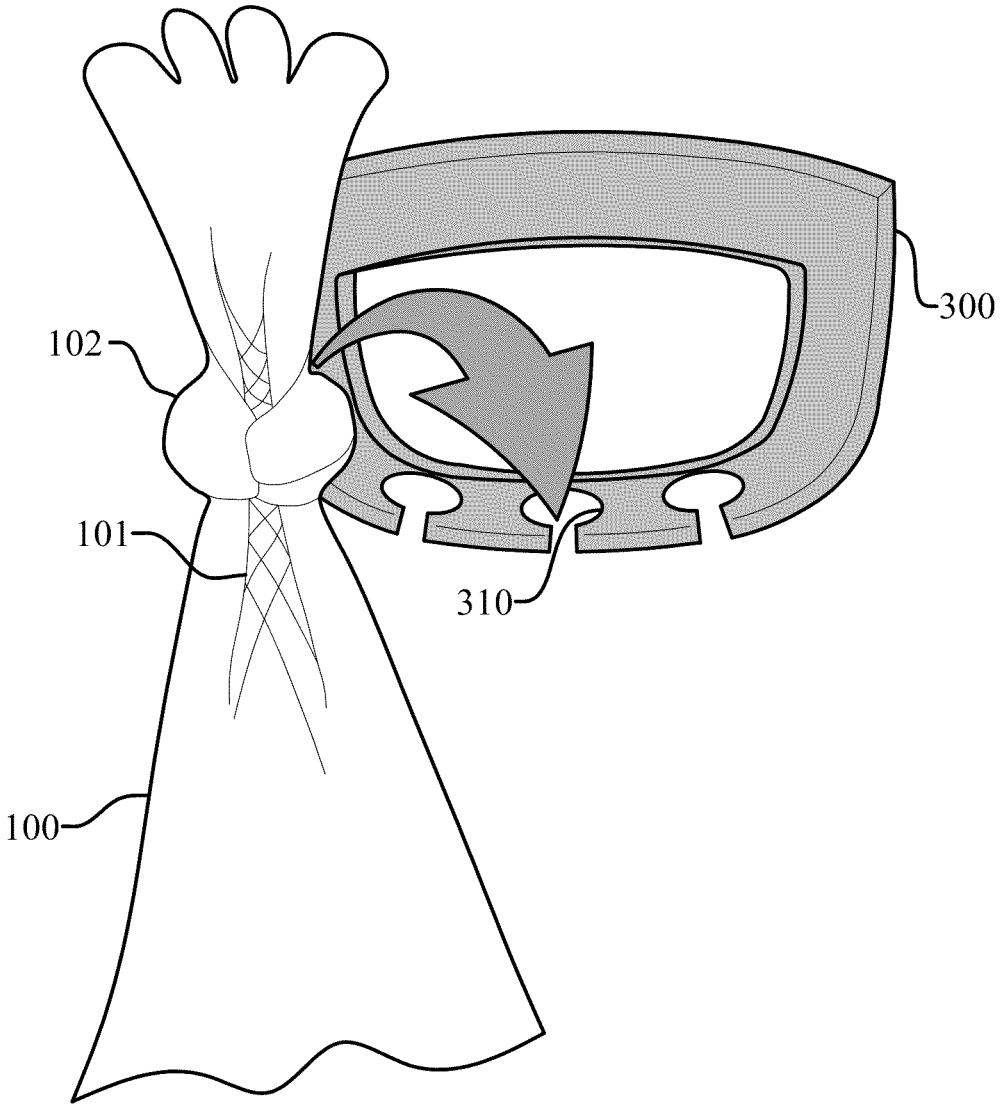
FIG. 17 shows an embodiment of a waste receiver and an embodiment of a handle of the biodegradable lawn waste collection system, not to scale.
Figure 18:
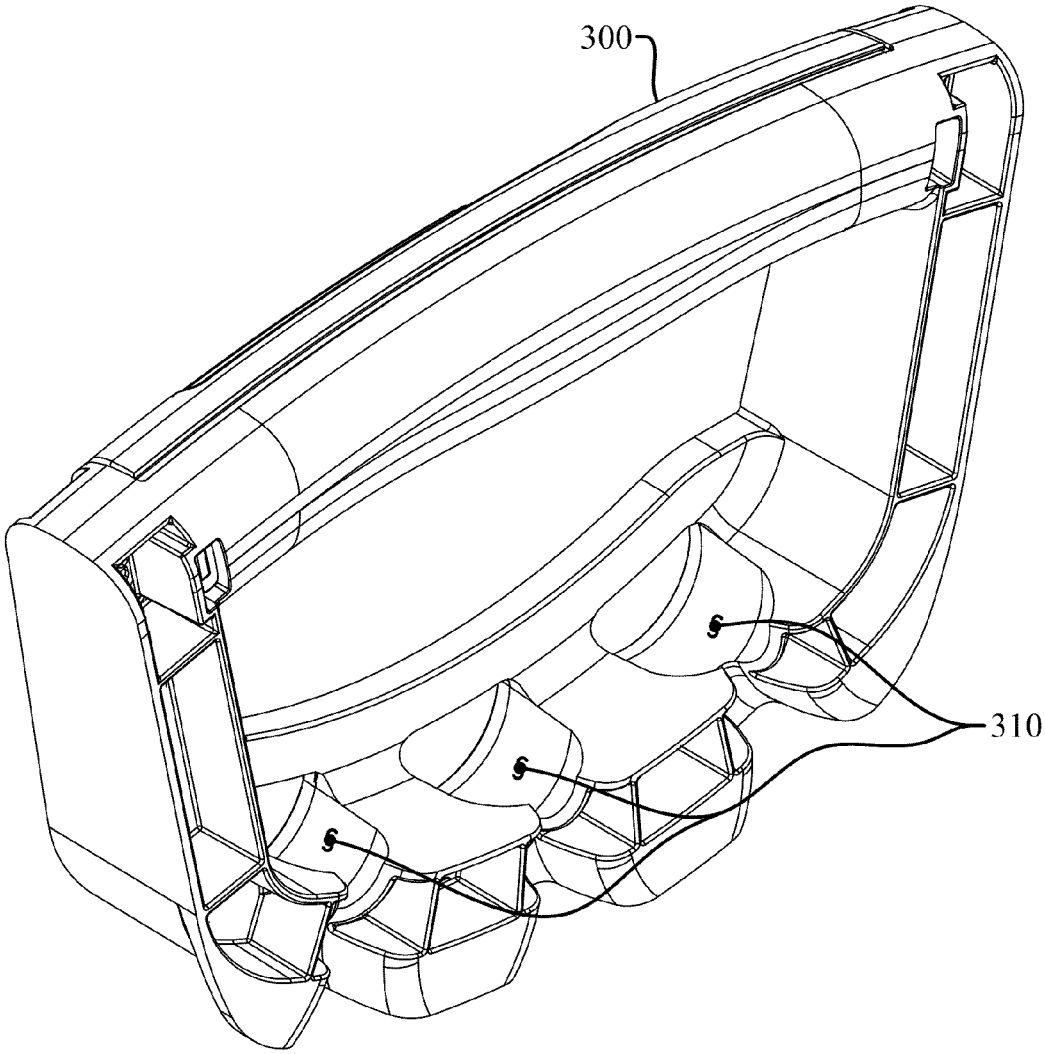
FIG. 18 shows a perspective view of an embodiment of a handle of the biodegradable lawn waste collection system, not to scale.

Referring now specifically to FIG. 17, the at least one attachment port (310) is configured as a recess to releasably attach the waste receiver (100). When the waste receiver (100) is picked up with, or dragged by, the handle (300), the weight of the waste receiver (100) will bear against the handle (300) and tend to lock the waste receiver (100) in position. The at least one attachment port (310) may also include a port depression. The port depression provides a seat in which a secured filling end (102) may bear on the handle (300), as seen in FIG. 18. The port depression may have a diameter in the range of about ¼ inch to about 1 inch in order to seat the secured filling end (102).

In one embodiment, the handle (300) includes at least two attachment ports (310) for releasable attachment with up to two waste receivers (100). In another embodiment, seen in FIGS. 18 and 19, the handle (300) includes at least three attachment ports (310) for releasable attachment with up to three waste receivers (100). The three attachment port (310) embodiment allows a user the flexibility to handle one, two, or three waste receivers (100) in a balanced manner. For instance, when handling a single waste receiver (100) the center attachment port (310) may be used. Moreover, when handling two waste receivers (100), the outer two attachment ports (310) may be used to balance the load. These embodiments allow multiple full waste receivers (100) to be transported by carrying or dragging the waste receivers (100) to the disposal destination. This is a great improvement over conventional paper lawn bags that are often difficult to transport individually, much less more than one at a time.

Figure 19:
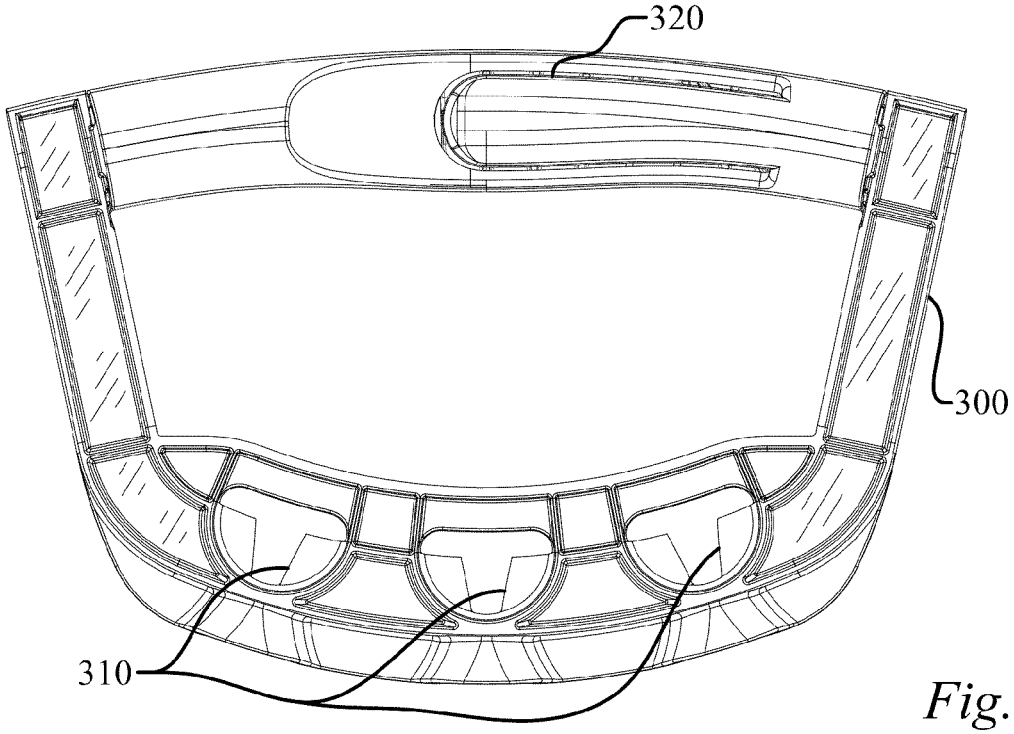
FIG. 19 shows a rear elevation view of an embodiment of a handle of the biodegradable lawn waste collection system, not to scale.
Figure 20:
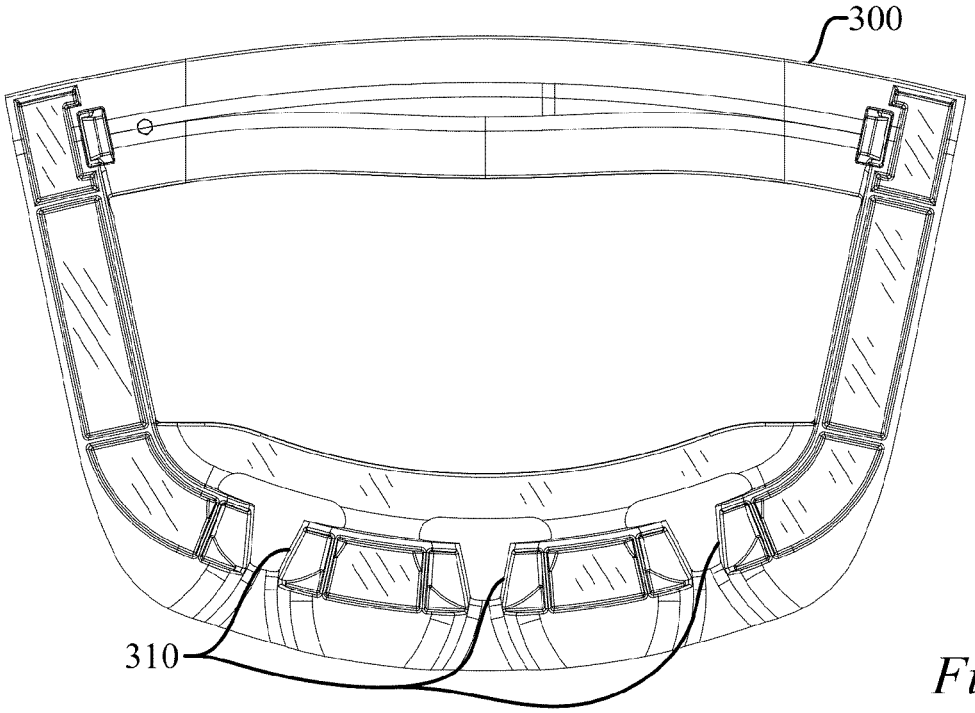
FIG. 20 shows a front elevation view of an embodiment of a handle of the biodegradable lawn waste collection system, not to scale.

Referring now to FIG. 19, in yet another embodiment, the handle (300) may be formed with a clip (320). The clip (320) allows a user to easily attach the handle (300) to a belt, a belt loop, or a pants' pocket when the handle (300) is not being utilized to carry waste receivers (100). The clip (320) and handle (300) may be formed as a single molded piece. Moreover, the clip (320) may be a separate piece that is subsequently joined to the handle (300) by a fastener or adhesives.

Numerous alterations, modifications, and variations of the preferred embodiments disclosed herein will be apparent to those skilled in the art and they are all anticipated and contemplated to be within the spirit and scope of the disclosed biodegradable lawn waste collection system (10). For example, although specific embodiments have been described in detail, those with skill in the art will understand that the preceding embodiments and variations can be modified to incorporate various types of substitute and or additional or alternative materials, relative arrangement of elements, and dimensional configurations. Accordingly, even though only few variations of the biodegradable lawn waste collection system (10) are described herein, it is to be understood that the practice of such additional modifications and variations and the equivalents thereof, are within the spirit and scope of the biodegradable lawn waste collection system (10) as disclosed herein. The corresponding structures, materials, acts, and equivalents of all means or step plus function elements in the claims below are intended to include any structure, material, or acts for performing the functions in combination with other claimed elements as specifically claimed.

We claim:

1. A biodegradable lawn waste collection system comprising:

(a) a waste receiver comprising an extruded tubular mesh structure formed from a biodegradable polymer composition, wherein the extruded tubular mesh structure has a pre-receiving configuration having a pre-receiving diameter ($D_{PR}$), a pre-receiving width ($W_{PR}$), and a pre-receiving volume, and the extruded tubular mesh structure is capable of expanding to a receiving configuration having a receiving diameter ($D_R$), a receiving width ($W_R$), wherein the pre-receiving diameter ($D_{PR}$) is at least 10 percent of the receiving diameter ($D_R$), and a receiving volume, the waste receiver including a filling end and a sealing end, wherein the waste receiver is formed with a color selected from the group consisting of: red, orange, yellow, green, blue, violet, black, and combinations thereof, wherein the color has an L* value that is less than or equal to 60;

(b) a shaping insert configured for removable reception within the waste receiver, wherein the shaping insert has a shaping insert perimeter, a shaping insert proximal end, a shaping insert distal end, and a continuous sidewall extending between the shaping insert proximal end and the shaping insert distal end such that the shaping insert has a tubular configuration;

wherein the shaping insert further comprises a collapsible tube having a spring-coil secured to the collapsible tube, wherein the spring-coil is capable of biasing the collapsible tube from a storage position to an expanded position;

wherein the shaping insert includes a first proximal handle secured to the shaping insert proximal end and a second proximal handle secured to the shaping insert proximal end in direct opposing relationship to the first proximal handle;

wherein the shaping insert further includes a first distal handle secured to the shaping insert distal end and a second distal handle secured to the shaping insert distal end in direct opposing relationship to the first distal handle, and wherein when the collapsible tube is in the storage position, the first distal handle substantially aligns with the first proximal handle and the second distal handle substantially aligns with the second proximal handle, a first proximal fastening device secured to a portion of the first proximal handle and a first distal fastening device secured to a portion of the first distal handle, wherein the first distal fastening device is configured for cooperative engagement with the first proximal fastening device;

a second proximal fastening device secured to a portion of the second proximal handle and a second distal fastening device secured to a portion of the second distal handle, wherein the second distal fastening device is configured for cooperative engagement with the second proximal fastening device; and wherein when the first proximal fastening device and first distal fastening device are cooperatively engaged the resiliency of the spring-coil places the first proximal fastening device in shear with the first distal fastening device, and when the second proximal fastening device and second distal fastening device are cooperatively engaged the resiliency of the spring-coil places the second proximal fastening device in shear with the second distal fastening device; and (c) a handle having at least one attachment port for releasable attachment with the waste receiver.

2. The system of claim 1, wherein the pre-receiving diameter ($D_{PR}$) is no more than 40 percent of the receiving diameter ($D_R$).

3. The system of claim 1, wherein the shaping insert has a circular shaping insert perimeter with a radius that is at least 50 percent greater than the pre-receiving diameter ($D_{PR}$).

4. The system of claim 1, wherein the shaping insert has a non-circular shaping insert perimeter selected from the group consisting of triangular, square, and rectangular, wherein the non-circular shaping insert perimeter is formed with rounded corners having a radius of curvature that is less than the pre-receiving diameter ($D_{PR}$).

5. The system of claim 1, wherein the shaping insert comprises a collapsible tube having a rounded insertion edge, wherein the rounded insertion edge has a radius of curvature that is at least 50 percent greater than the pre-receiving diameter ($D_{PR}$) and is less than 5 times greater than the pre-receiving diameter ($D_{PR}$).

6. The system of claim 1, wherein the biodegradable polymer composition comprises polylactic acid.

7. The system of claim 1, wherein the sealing end is heat staked such that the waste receiver is sealed at the sealing end.

8. The system of claim 1, wherein the handle includes at least two attachment ports for releasable attachment with up to two waste receivers.

9. The system of claim 1, wherein the handle is formed with a clip.

10. A biodegradable lawn waste collection system comprising:

(a) a waste receiver comprising an extruded tubular mesh structure formed from a biodegradable polymer composition, wherein the extruded tubular mesh structure has an initial configuration having an initial diameter ($D_I$), an initial width ($W_I$), and an initial volume, the waste receiver including a filling end and a sealing end, wherein the waste receiver is formed with a color selected from the group consisting of: red, orange, yellow, green, blue, violet, black, and combinations thereof, wherein the color has an L* value that is less than or equal to 60; and (b) a shaping insert configured for removable reception within the waste receiver, wherein the shaping insert has a shaping insert perimeter, a shaping insert proximal end, a shaping insert distal end, and a continuous sidewall extending between the shaping insert proximal end and the shaping insert distal end such that the shaping insert has a tubular configuration;

wherein the shaping insert comprises a collapsible tube having a spring-coil secured to the collapsible tube, wherein the spring-coil is capable of biasing the collapsible tube from a storage position to an expanded position;

wherein the shaping insert includes a first proximal handle secured to the shaping insert proximal end and a second proximal handle secured to the shaping insert proximal end in direct opposing relationship to the first proximal handle;

wherein the shaping insert further includes a first distal handle secured to the shaping insert distal end and a second distal handle secured to the shaping insert distal end in direct opposing relationship to the first distal handle, and wherein when the collapsible tube is in the storage position, the first distal handle substantially aligns with the first proximal handle and the second distal handle substantially aligns with the second proximal handle;

a first proximal fastening device secured to a portion of the first proximal handle and a first distal fastening device secured to a portion of the first distal handle, wherein the first distal fastening device is configured for cooperative engagement with the first proximal fastening device;

a second proximal fastening device secured to a portion of the second proximal handle and a second distal fastening device secured to a portion of the second distal handle, wherein the second distal fastening device is configured for cooperative engagement with the second proximal fastening device; and wherein when the first proximal fastening device and first distal fastening device are cooperatively engaged the resiliency of the spring-coil places the first proximal fastening device in shear with the first distal fastening device, and when the second proximal fastening device and second distal fastening device are cooperatively engaged the resiliency of the spring-coil places the second proximal fastening device in shear with the second distal fastening device.

11. The system of claim 10, wherein the extruded tubular mesh structure is capable of expanding from the initial configuration to a pre-receiving configuration having a pre-receiving diameter ($D_{PR}$), a pre-receiving width ($Wp_R$), and a pre-receiving volume by inserting an expansion device within the extruded tubular mesh structure and causing the extruded tubular mesh structure to pass over the expansion device.

12. The system of claim 11, wherein the expansion device has an expansion diameter ($D_E$) that is at least three times greater than the initial diameter ($D_I$).

13. The system of claim 11, wherein the pre-receiving diameter ($D_{PR}$) is at least 50 percent greater than the initial diameter ($D_I$), the pre-receiving width ($W_{PR}$) is at least 50 percent greater than the initial width ($W_I$), and the pre-receiving volume is at least 50 percent greater than the initial volume.

14. The system of claim 13, wherein the shaping insert has a circular shaping insert perimeter with a radius that is at least 50 percent greater than the pre-receiving diameter ($D_{PR}$).

15. The system of claim 13, wherein the shaping insert has a non-circular shaping insert perimeter selected from the group consisting of triangular, square, and rectangular, wherein the non-circular shaping insert perimeter is formed with rounded corners having a radius of curvature that is greater than the initial diameter ($D_I$) and less than the pre-receiving diameter ($D_{PR}$).

16. The system of claim 13, wherein the shaping insert comprises a collapsible tube having a rounded insertion edge, wherein the rounded insertion edge has a radius of curvature that is at least 50 percent greater than the pre-receiving diameter ($D_{PR}$) and is less than 5 times greater than the pre-receiving diameter ($D_{PR}$).

* * * * *